US009653016B2

(12) United States Patent
Baek et al.

(10) Patent No.: US 9,653,016 B2
(45) Date of Patent: *May 16, 2017

(54) DISPLAY DEVICE

(71) Applicant: Samsung Display Co. Ltd., Yongin (KR)

(72) Inventors: Seung-Soo Baek, Suwon-si (KR); Se Hyoung Cho, Seoul (KR); Dong-Gyu Kim, Yongin-si (KR); Dong-Hyeon Ki, Asan-si (KR)

(73) Assignee: SAMSUNG DISPLAY CO. LTD, Yongin (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/095,853

(22) Filed: Apr. 11, 2016

(65) Prior Publication Data

US 2016/0225308 A1 Aug. 4, 2016

Related U.S. Application Data

(63) Continuation of application No. 13/410,766, filed on Mar. 2, 2012, now Pat. No. 9,311,842.

(30) Foreign Application Priority Data

Aug. 23, 2011 (KR) ..... 10-2011-0084123

(51) Int. Cl.

| | |
|---|---|
| ***G09G 3/20*** | (2006.01) |
| *G09G 3/3266* | (2016.01) |
| *G09G 3/36* | (2006.01) |

(52) U.S. Cl.

CPC ..... *G09G 3/2092* (2013.01); *G09G 3/2022* (2013.01); *G09G 3/3266* (2013.01); (Continued)

(58) Field of Classification Search

None

See application file for complete search history.

(56) References Cited

U.S. PATENT DOCUMENTS

| | | | |
|---|---|---|---|
| 4,958,303 | A | 9/1990 | Assarpour et al. |
| 5,233,690 | A | 8/1993 | Sherlock et al. |

(Continued)

FOREIGN PATENT DOCUMENTS

| | | | |
|---|---|---|---|
| JP | 09005780 | A | 1/1997 |
| JP | 2006276401 | A | 10/2006 |

(Continued)

*Primary Examiner* — David D Davis

(74) *Attorney, Agent, or Firm* — Cantor Colburn LLP

(57) ABSTRACT

A display device includes: a display panel including a display area, and a peripheral area disposed in the vicinity of the display area; a scan driver including a plurality of stages integrated on the peripheral area; a plurality of gate lines connected to the plurality of stages, respectively; and a plurality of pixel rows in the display area and connected with the plurality of gate lines, respectively. The plurality of stages and the plurality of pixel rows are each arranged in a first direction in a line, the peripheral area includes a fan-out region between the plurality of stages and the plurality of pixel rows, and at least one of the plurality of gate lines in the fan-out region is inclined with respect to the first direction, and a second direction perpendicular to the first direction.

45 Claims, 24 Drawing Sheets

(52) U.S. Cl.
CPC ... *G09G 3/3674* (2013.01); *G09G 2300/0408* (2013.01); *G09G 2300/0413* (2013.01); *G09G 2300/0426* (2013.01); *G09G 2310/0267* (2013.01); *G09G 2310/0281* (2013.01); *G09G 2310/0286* (2013.01)

(56) References Cited

U.S. PATENT DOCUMENTS

| | | | | |
|---|---|---|---|---|
| 5,269,001 | A | 12/1993 | Guttag | |
| 8,692,754 | B2 | 4/2014 | Lee et al. | |
| 9,311,842 | B2 * | 4/2016 | Baek | G09G 3/2022 |
| 2006/0001638 | A1 | 1/2006 | Jeon et al. | |
| 2006/0006653 | A1 | 1/2006 | Ricketts | |
| 2006/0066553 | A1 | 3/2006 | Deane | |
| 2007/0002243 | A1 | 1/2007 | Kim | |
| 2010/0060840 | A1 | 3/2010 | Ku | |
| 2010/0109993 | A1 | 5/2010 | Chang | |
| 2012/0098811 | A1 | 4/2012 | Park | |
| 2012/0169578 | A1 | 7/2012 | Kim et al. | |

FOREIGN PATENT DOCUMENTS

| | | | |
|---|---|---|---|
| JP | 2007017478 | A | 1/2007 |
| JP | 2007107478 | A | 1/2007 |
| JP | 2008020675 | A | 1/2008 |
| JP | 2010230784 | A | 10/2010 |
| KR | 1020060047064 | A | 5/2006 |
| KR | 1020070120229 | A | 12/2007 |
| KR | 1020100009906 | A | 1/2010 |
| KR | 1020110033602 | A | 3/2011 |

* cited by examiner

DISPLAY DEVICE

This application is a continuation of U.S. patent application Ser. No. 13/410,766, filed on Mar. 2, 2012, which claims priority to Korean Patent Application No. 10-2011-0084123 filed on Aug. 23, 2011, and all the benefits accruing therefrom under 35 U.S.C. §119, the entire contents of which are incorporated herein by reference.

BACKGROUND OF THE INVENTION (a) Field of the Invention

The invention relates to a display device. More particularly, the invention relates to a display device including a gate driver.

(b) Description of the Related Art

In general, a display device includes a plurality of pixels which are the unit of displaying an image, and a driver. The driver includes a data driver applying data voltage to a pixel, and a gate driver applying a gate signal for controlling the transferring of the data voltage. In the related art, a method in which the gate driver and the data driver are mounted on a printed circuit board ("PCB") in a chip type to be connected to a display panel, or the driver chip is mounted directly on the display panel, was primarily used. However, a structure in which the gate driver not requiring high mobility of a thin film transistor channel is not constituted by a separate chip but integrated on the display panel has been developed.

The gate driver includes a shift register constituted by a plurality of stages which are connected dependently and a plurality of signal lines transferring the driving signal thereto. Each of the plurality of stages is connected to one gate line and the plurality of stages output the gate signal to each of the gate lines sequentially according to a predetermined order.

BRIEF SUMMARY OF THE INVENTION

The invention has been made in an effort to provide a display device having an advantage of providing a high degree of freedom for a design of a peripheral area in which a gate driver is disposed in the display device including the gate driver integrated on a display panel. Further, the invention has been made in an effort to provide a display device having an advantage of reducing an area of the peripheral area of the display panel.

An exemplary embodiment of the invention provides a display device including: a display panel including a display area, and a peripheral area disposed around the display area; a scan driver including a plurality of stages integrated on the peripheral area; a plurality of gate lines respectively connected to the plurality of stages; and a plurality of pixel rows disposed in the display area and respectively connected with the plurality of gate lines. The plurality of stages are arranged in a first direction in a line, and the plurality of pixel rows are arranged in the first direction in a line, the peripheral area includes a fan-out region disposed between a region where the plurality of stages are disposed and a region where the plurality of pixel rows are disposed, and at least one of the plurality of gate lines disposed in the fan-out region extends in a direction which is not parallel to the first direction, and not parallel a second direction perpendicular to the first direction.

A first stage of the plurality of stages and a first pixel row of the plurality of pixel rows may be connected to each other by one gate line among the plurality of gate lines, and the first stage and the first pixel row may not be aligned with each other but are misaligned with respect to the second direction.

An uppermost scanned stage among the plurality of stages and an uppermost pixel row among the plurality of pixel rows may not be aligned with each other and may be misaligned with respect to the second direction.

A first directional distance in the first direction between an upper edge of the first stage and an upper edge of the first pixel row may be equal to or more than a first directional width in the first direction of the first stage.

A last stage of the plurality of stages and a last pixel row of the plurality of pixel rows are misaligned in the second direction.

A first directional width in the first direction of each of the plurality of stages may be constant.

A first directional width in the first direction of the plurality of pixel rows may be constant.

The first directional width of each of the plurality of stages and the first directional width of each of the plurality of pixel rows may be the same as each other.

The first directional width of each of the plurality of stages and the first directional width of each of the plurality of pixel rows may be different from each other.

At least one of the plurality of gate lines disposed in the fan-out region may extend parallel to the second direction.

A gate line of the plurality of gate lines disposed in the fan-out region may extends parallel to the second direction, and remaining gate lines other than the gate line among the plurality of gate lines may form angles increasing in a direction away from the gate line with respect to the second direction.

The plurality of gate lines disposed in the fan-out region may extend in a direction which is not parallel to the second direction, and may be parallel to each other.

An uppermost stage among the plurality of stages and an uppermost pixel row of the plurality of pixel rows may be aligned in the second direction, or a last stage among the plurality of stages and a last pixel row among the plurality of pixel rows may be aligned in the second direction.

A first directional distance in the first direction between an upper edge of the first stage and an upper edge of the first pixel row may be equal to or more than a first directional width in the first direction of the first stage.

The plurality of pixel rows may include a first block including at least one pixel row and a second block including at least one pixel row different from the at least one pixel row of the first block, and a first directional width in the first direction of a pixel row included in the first block and a first directional width in the first direction of a pixel row included in the second block may be different from each other.

The first directional width of the pixel row included in the first block may be the same as a first directional width in the first direction of a first stage included in the plurality of stages.

The plurality of stages may include a first stage, and a second stage different from the first stage, of which first directional widths in the first direction may not be equal to each other.

The second block may be disposed below the first block in a plan view, the second block may include a dummy pixel, and the dummy pixel may be disposed in the peripheral area.

A stage connected with a pixel row of the second block through a gate line may include a dummy stage.

A last pixel row of the second block and a last stage among the plurality of stages may be aligned with respect to the second direction.

The display device may further include a reset stage disposed below the plurality of stages in a plan view.

The lower edge of the reset stage and the lower edge of the last pixel row among the plurality of pixel rows may be aligned with respect to the second direction.

The plurality of stages may include a third block including at least one stage and a fourth block including at least one stage different from the at least one stage of the third block, and a first directional width in the first direction of a stage of the third block may be different from a first directional width in the first direction of a stage of the fourth block.

The first directional width of the stage included in the third block may be the same as a first directional width in the first direction of a first pixel row included in the plurality of pixel rows.

The plurality of pixel rows may include a first pixel row, and a second pixel row different from the first pixel row, of which first directional widths in the first direction may not be the same as each other.

The plurality of stages may include a dummy stage.

The plurality of gate lines may include two gate lines having thicknesses which are different from each other in the fan-out region.

Thicknesses of the gate lines in the fan-out region may increase or decrease gradually when the gate lines taken along the first direction.

At least one of the plurality of gate lines may be bent at least once in the fan-out region.

A number of bending points at which the gate lines are bent in the fan-out region may increase or decrease gradually when the gate lines are taken along the first direction.

A bent gate line in the fan-out region may include a portion parallel to the first direction or the second direction.

A gate line in the fan-out region may be periodically bent in a waveform.

An amplitude of the waveform of the gate lines in the fan-out region may increase or decrease gradually when the gate lines are taken along the first direction.

A length of the plurality of gate lines in the fan-out region may be constant.

According to exemplary embodiments of the invention, it is possible to provide a high degree of freedom for a design of a peripheral area in which a gate driver is disposed in the display device including the gate driver integrated on a display panel, and reduce an area of the peripheral area of the display panel.

BRIEF DESCRIPTION OF THE DRAWINGS

The above and other features of this disclosure will become more apparent by describing in further detail exemplary embodiments thereof with reference to the accompanying drawings, in which.

DETAILED DESCRIPTION OF THE INVENTION

Figure 1:
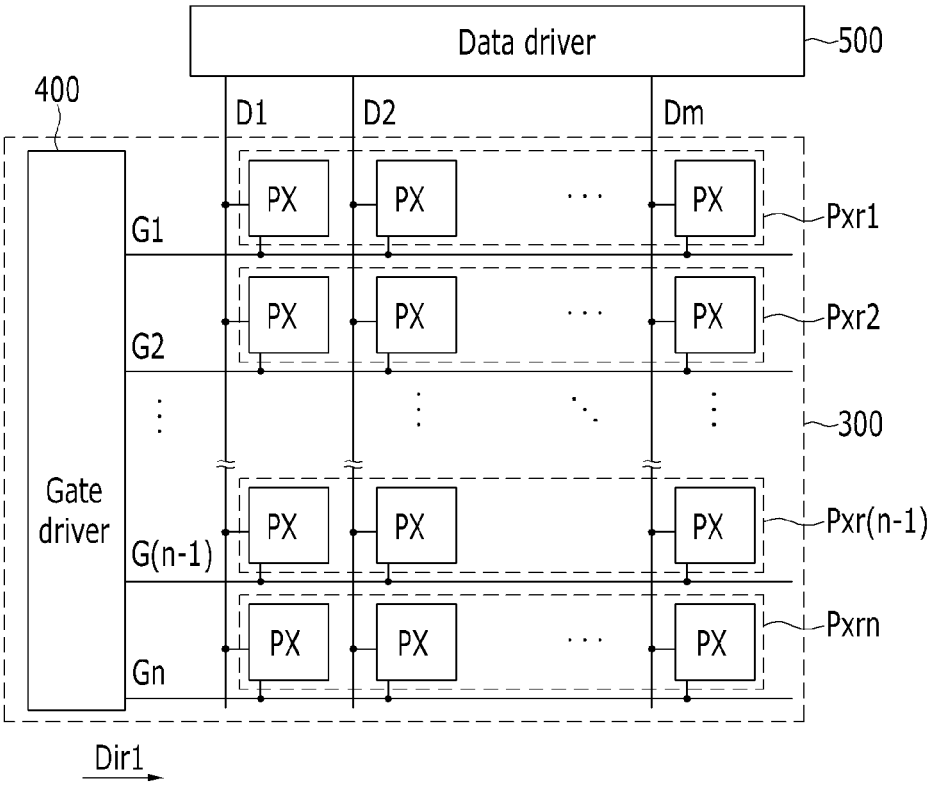
FIG. 1 is a block diagram of an exemplary embodiment of a display device according to the invention.

The invention will be described more fully hereinafter with reference to the accompanying drawings, in which exemplary embodiments of the invention are shown. As those skilled in the art would realize, the described embodiments may be modified in various different ways, all without departing from the spirit or scope of the invention.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "below," "above," and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "below" relative to other elements or features would then be oriented "above" relative to the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the invention will be described in detail with reference to the accompanying drawings.

First, an exemplary embodiment of a display device according to the invention will be described with reference to FIGS. 1 and 2.

Figure 2:
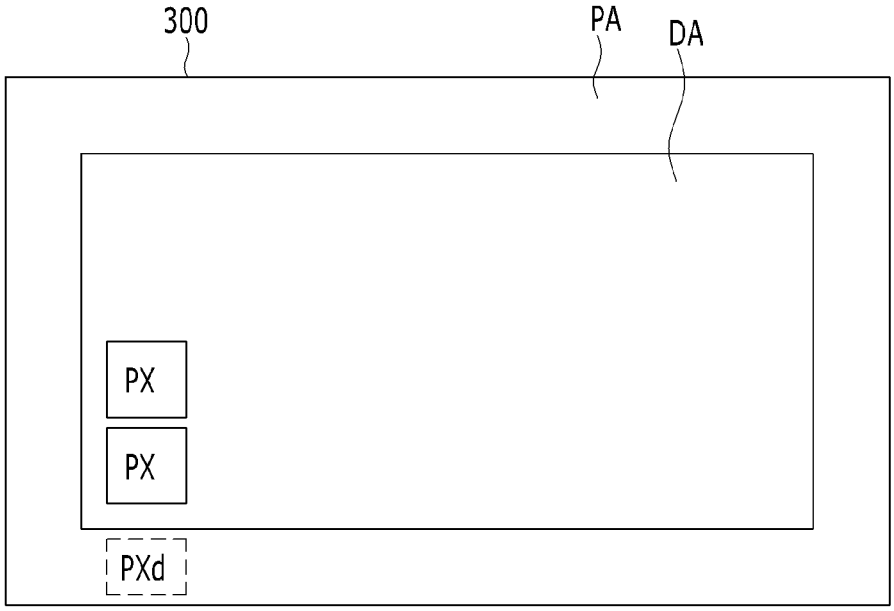
FIG. 2 is a plan view of an exemplary embodiment of a display device according to the invention.

FIG. 1 is a block diagram of an exemplary embodiment of a display device according to the invention and FIG. 2 is a plan view of an exemplary embodiment of a display device according to an exemplary embodiment of the invention.

Referring to FIG. 1, a display device includes a display panel 300, a gate driver 400, and a data driver 500.

The display panel 300 includes a plurality of gate lines G1-Gn, a plurality of data lines D1-Dm, and a plurality of pixels PX connected to the plurality of gate lines G1-Gn and the plurality of data lines D1-Dm. Referring to FIG. 2, the display panel 300 includes a display area DA where the plurality of pixels PX are arranged and an image is displayed, and a peripheral area PA around the display area DA.

The gate lines G1-Gn transfer gate signals, substantially extend in a first direction Dir1 as a row direction, and may be substantially parallel to each other. The data lines D1-Dm transfer data voltage corresponding to an image signal, substantially extend in a column direction, and may be substantially parallel to each other.

The plurality of pixels PX are substantially arranged in a matrix form and may include a plurality of pixel rows PXr1-PXrn arranged in a column direction. Each of the pixel rows PXr1-PXrn includes a plurality of pixels PX arranged in the row direction Dir1 and one of the pixel rows PXr1-PXrn may include the pixels PX having the number of data lines D1-Dm of at least m. Each of the pixel rows PXr1-PXrn may be connected with one of the gate lines G1-Gn, but is not limited thereto. In an alternative exemplary embodiment, for example, each of the pixel rows PXr1-PXrn may be connected with two or more gate lines G1-Gn and one gate line may also be disposed every two or more pixel rows PXr1-PXrn. In this case, the number of the gate lines G1-Gn in the display panel 300 may be different from the number of the pixel rows PXr1-PXrn.

Each pixel PX may include a switching element (not shown) connected with the gate lines G1-Gn and the data lines D1-Dm, and a pixel electrode (not shown) connected thereto. The switching element may be a three-terminal element of a thin film transistor and the like, integrated on the display panel 300.

Referring to FIG. 2, the peripheral area PA of the display panel 300 may be covered (e.g., overlapped) by a light blocking member (not shown) and the like. A dummy pixel PXd may be disposed in the peripheral area PA. The dummy pixel PXd may be disposed in the peripheral area PA below or above the display area DA in the plan view. The dummy pixel PXd may have the same structure as the pixel PX arranged in the display area DA. The dummy pixel PXd may be connected with a portion of the gate driver 400 through a dummy gate line (not shown).

The data driver 500 is connected with the data lines D1-Dm of the display panel 300 to transfer data voltage to the data lines D1-Dm. The data driver 500 may include a plurality of data driving chips.

The gate driver 400 is disposed on the display panel 300. The gate driver 400 is connected with the plurality of gate lines G1-Gn to transfer gate signals to the gate lines G1-Gn in sequence. The gate driver 400 may include a plurality of thin film transistors, a plurality of capacitors, and the like. In an exemplary embodiment of forming the display device, the plurality of thin film transistors and the plurality of capacitors of the gate driver 400 may be integrated in the peripheral area PA in the same process as the elements of the thin film transistor and the like disposed in the display area DA.

The gate driver 400 may include a shift register including a plurality of stages (not shown) subordinately connected to each other, and a driving wiring transferring various driving signals thereto.

A plurality of stages and a plurality of pixel rows PXr1-PXrn included in the gate driver 400 will be described with reference to FIGS. 3 to 21.

Figure 3:
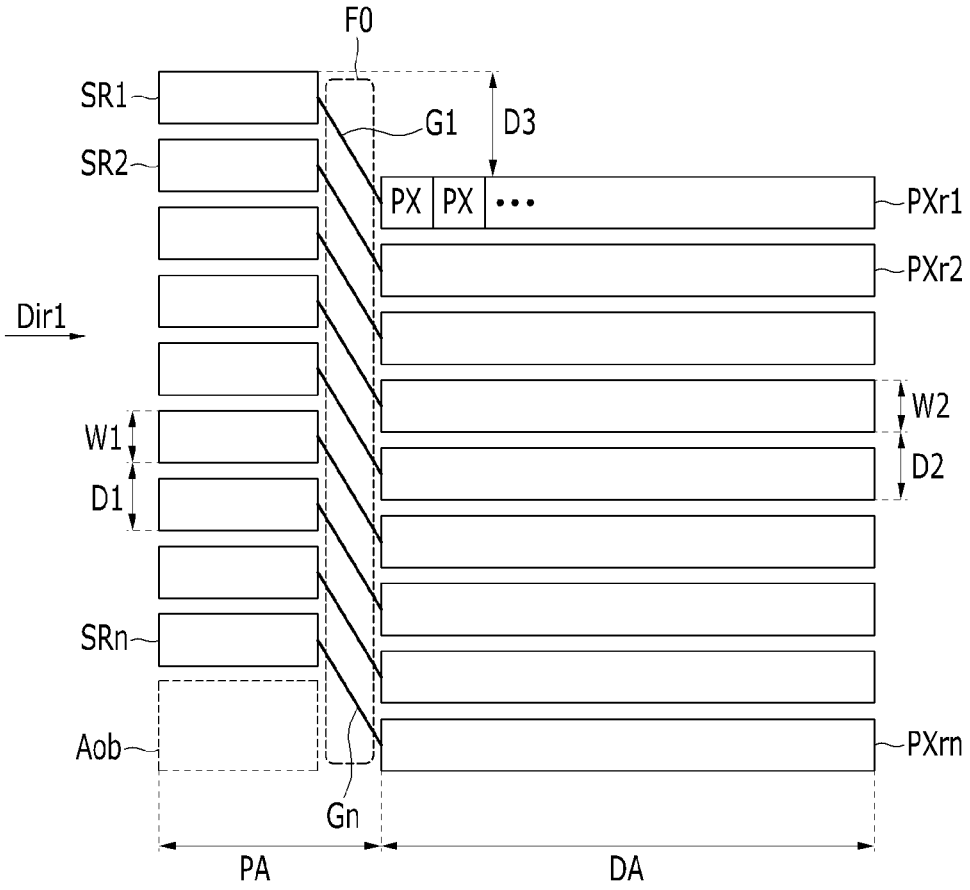
FIG. 3 is a plan view of an exemplary embodiment of a plurality of stages and a plurality of pixel rows included in a gate driver of a display device according to the invention.
Figure 4:
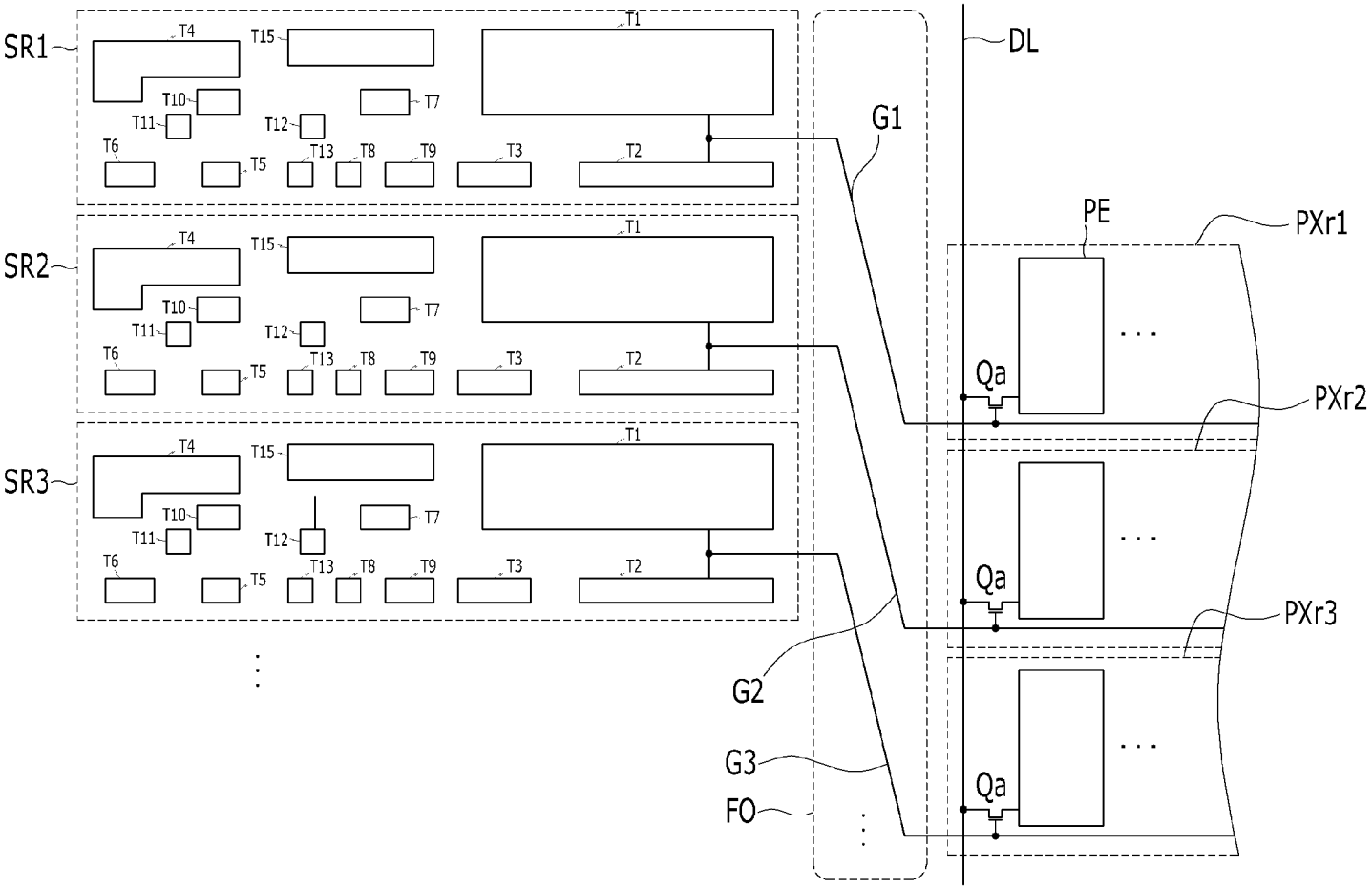
FIG. 4 is a plan view of an exemplary embodiment of some stages of a gate driver and a pixel row and a gate line connected thereto of a display device according to the invention.

FIG. 3 is a plan view of an exemplary embodiment a plurality of stages and a plurality of pixel rows included in a gate driver of a display device according to the invention, FIG. 4 is a plan view of an exemplary embodiment of some stages of a gate driver and a pixel row and a gate line connected thereto of a display device according to the invention, and FIGS. 5 to 21 are plan views of other exemplary embodiments of a plurality of stages and a plurality of pixel rows included in a gate driver of a display device according to the invention, respectively.

Referring to FIGS. 3 to 21, the gate driver 400 includes a plurality of stages SR1, SR2, . . . , and SRn subordinately connected to each other. Each of the stages SR1, SR2, . . . , and SRn is connected with one of the gate lines G1-Gn to respectively output a gate signal including a gate-off voltage Voff and gate-on voltage Von, to the gate lines G1-Gn. Each of the stages SR1, SR2, . . . , and SRn may include a plurality of thin film transistors and capacitors integrated in the peripheral area PA of the display panel 300, as described above. Detailed configurations of the plurality of stages SR1, SR2, . . . , and SRn and the driving wiring of the gate driver 400 according to the invention may comply with the configurations of the stages and the driving wiring of the gate driver which may be known in the art and can be understood by those skilled in the art, such that further description is omitted for convenience.

The plurality of stages SR1-SRn may be arranged in a line with a substantially predetermined interval along the column direction which is substantially perpendicular to the first direction Dir1. A column directional width W1 of the plurality of stages SR1-SRn of the gate driver 400 may be constant. A pitch D1 of the plurality of stages SR1-SRn, for example, a column directional distance between an upper edge or lower edge of one of the stages SR1-SRn and an upper edge or lower edge of an adjacent one of the stages SR1-SRn may also be constant. In this case, the upper edge or lower edge of the stages SR1-SRn may mean an upper edge or lower edge of the area including electric elements of the plurality of transistors and capacitors and the wiring of the corresponding stages SR1-SRn.

The plurality of pixel rows PXr1-PXrn are disposed in the display area DA of the display panel 300. A column directional width W2 of each of the plurality of pixel rows PXr1-PXrn may be constant. A pitch D2 of the plurality of pixel rows PXr1-PXrn, for example, a distance between an upper edge or lower edge of one of the pixel rows PXr1-PXrn and an upper edge or lower edge of an adjacent one of the pixel rows PXr1-PXrn may also be substantially constant. A distance between the adjacent pixel rows PXr1-

PXrn may be 0. In other words, the column directional width W2 of each of the pixel rows PXr1-PXrn and the pitch D2 of the pixel rows PXr1-PXm may be the same.

In this case, the upper edge or lower edge of the pixel PX or pixel rows PXr1-PXrn may mean an upper edge or lower edge of the area including electric elements of the wiring, the electrode, and the like of the corresponding pixel PX or pixel PX of the pixel rows PXr1-PXrn.

The plurality of stages SR1-SRn of the gate driver 400 in the peripheral area PA and the plurality of pixel rows PXr1-PXrn in the display area DA may be in one to one correspondence. Each of the stages SR1-SRn and each of the pixel rows PXr1-PXrn in one to one correspondence are connected to each other through the gate lines G1-Gn disposed at a fan-out region FO. The fan-out region FO indicated by a dotted line in FIG. 3 is included in the peripheral area PA and defined as an area between the area with the entire stages SR1-SRn and the area with the entire pixel rows PXr1-PXrn, and may be disposed on the border between the display area DA and the peripheral area PA. In the exemplary embodiments shown in FIGS. 3 to 21, the gate lines G1-Gn disposed in the display area DA are not shown, but the gate lines G1-Gn may be along each of the pixel rows PXr1-PXrn in the display area DA.

According to the exemplary embodiments of the invention, at least one of the gate lines G1-Gn disposed at the fan-out region FO may obliquely extend with respect to the first direction Dir1 or the row direction.

Figure 5:
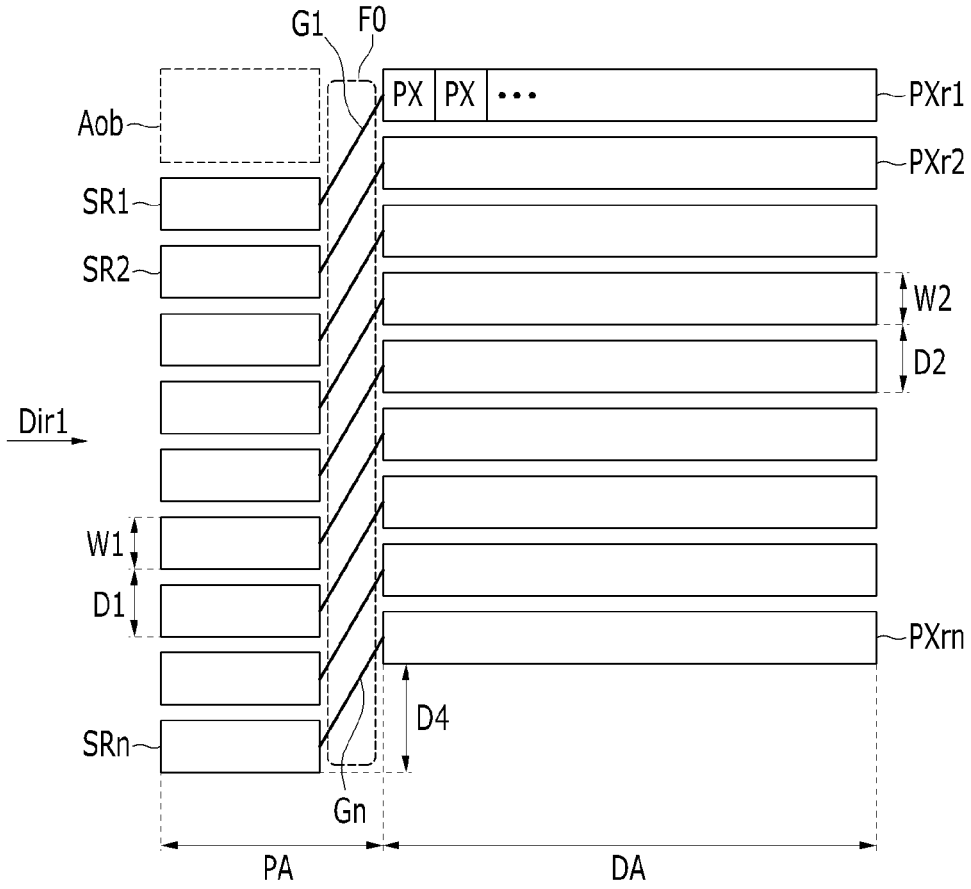
FIGS. 5 to 21 are plan views of other exemplary embodiments of a plurality of stages and a plurality of pixel rows included in a gate driver of a display device according to the invention, respectively.

First, referring to FIGS. 3 to 5, the pitch D1 of the plurality of stages SR1-SRn may be the same as the pitch D2 of the plurality of pixel rows PXr1-PXrn. Further, the column directional width W1 of each of the stages SR1-SRn and the column directional width W2 of each of the pixel rows PXr1-PXrn may also be the same as each other. Accordingly, the column directional width of the entire stages SR1-SRn and the column directional width of the entire pixel rows PXr1-PXrn may be the same as each other. Further, the gate lines G1-Gn in the fan-out region FO may be parallel to each other.

Referring to the exemplary embodiment of FIG. 4, one stage SR1, SR2, SR3, . . . of the gate driver 400 according to the invention includes a plurality of thin film transistors T1-T15. In FIG. 4, T14 is not shown for convenience. The plurality of thin film transistors T1-T15 receive several driving signals and generate a gate signal including the gate-on voltage Von and the gate-off voltage Voff to output the generated gate signal through gate lines G1, G2, G3, . . . . The gate lines G1, G2, G3, . . . respectively connected with each stage SR1, SR2, SR3, . . . are further respectively connected with each pixel row PXr1, PXr2, PXr3, . . . and the switching element Qa of the thin film transistor in the pixel row and the like. Each pixel row PXr1, PXr2, PXr3, . . . may include a plurality of pixel electrodes PE arranged in a row direction Dir1 and each pixel electrode PE is connected with the respective gate line G1, G2, G3, . . . and a corresponding data line DL through the switching element Qa.

Referring back to FIGS. 3 and 5, each of the stages SR1-SRn and each of the pixel rows PXr1-PXrn which are respectively connected with each other through the gate lines G1-Gn may not be arranged in the first direction Dir1, that is, the row direction and may be misaligned to each other. In the illustrated exemplary embodiments, for example, a column directional distance D3 (FIG. 3) between an upper edge or an extension thereof of the uppermost stage SR1 in the plan view and an upper edge or an extension thereof of the uppermost pixel row PXr1 in the plan view, or a column directional distance D4 (FIG. 5) between a lower edge or an extension thereof of the last stage SRn and a lower edge or an extension thereof of the last pixel row PXrn may be equal to or more than the column directional width W1 or one pitch D1 of each of the stages SR1-SRn. Hereinafter, an upper edge of one element means an actual upper edge or an extension thereof, and a lower edge of one element means an actual lower edge or an extension thereof.

When the column directional width W1 of the stages SR1-SRn and the column directional width W2 of the pixel rows PXr1-PXrn are the same as each other, what the stages SR1-SRn and the pixel rows PXr1-PXrn which correspond to each other are arranged in a row direction Dir1 may mean that the upper edge (or the lower edge) of the stages SR1-SRn and the upper edge (or the lower edge) of the pixel rows PXr1-PXrn are disposed on the same line extending in a row direction Dir1.

When the column directional width W1 of each of the stages SR1-SRn and the column directional width W2 of each of the pixel rows PXr1-PXrn are different from each other, and when it is said that a pair of a stage SR1-SRn and a pixel row PXr1-PXrn corresponding to each other are aligned in a row direction Dir1, it may mean that the upper edge and the lower edge of one side having a smaller column directional width of the pair of the corresponding stage SR1-SRn and the pixel row PXr1-PXrn are disposed between the upper edge and the lower edge of the other side having a larger column directional width of the corresponding pair, or disposed on the same line in a row direction Dir1 as the upper edge or the lower edge of the other side having a larger column directional width of the corresponding pair. In this case, the upper edge and the lower edge of one side having the smaller column directional width of the corresponding pair may not be misaligned above the upper edge or below the lower edge of the other side having the larger column directional width. Accordingly, what the stages SR1-SRn and the pixel rows PXr1-PXrn which correspond to each other are not aligned in the row direction Dir1 and are misaligned to each other may mean the case other than the aligned case. This may be equally applied even to a subsequent description.

Referring to FIGS. 3 to 5, at least one of the gate lines G1-Gn in the fan-out region FO is not parallel to a row direction and forms a predetermined angle, which is not 0, with respect to the first direction Dirt that is, the row direction to extend in a diagonal direction.

As described above, when the plurality of stages SR1-SRn of the gate driver 400 are not aligned with the plurality of pixel rows PXr1-PXrn but are shifted upward or downward, as shown in FIGS. 3 and 4, an empty space Aob disposed below or above the plurality of stages SR1-SRn may be ensured, and if necessary, various elements such as a dummy stage, a pad for inspection, a static diode, and the like or a pattern such as an alignment key for alignment of a mask and the like may be in the empty space, such that the high degree of freedom in a manufacturing process may be obtained.

Next, referring to FIGS. 6 to 13 together, the exemplary embodiments of the plurality of stages SR1-SRn and the plurality of pixel rows PXr1-PXrn according to the invention are substantially the same as the exemplary embodiment shown in FIGS. 3 to 5, but the column directional width of the entire stages SR1-SRn and the column directional width of the entire pixel rows PXr1-PXrn may be different from each other.

In detail, the column directional width W1 of at least one stage of the plurality of stages SR1-SRn may be different from the column directional width W2 of each of the pixel rows PXr1-PXrn. Further, the pitch D2 of the entire pixel rows PXr1-PXrn and the column directional width W2 of each of the pixel rows PXr1-PXrn may be constant. Accordingly, the pitch D1 for at least some of the plurality of stages SR1-SRn and the pitch D2 of the plurality of pixel rows PXr1-PXrn may be different from each other.

According to the exemplary embodiments shown in FIGS. 6, 7, 8, and 12 in which the column directional width of the entire stages SR1-SRn is smaller than the column directional width of the entire pixel rows PXr1-PXrn, the extra space Aob adjacent to the pixel rows PXr1-PXrn and disposed below and/or above the entire stages SR1-SRn may be ensured. According to the exemplary embodiments shown in FIGS. 9, 10, 11, and 13 in which the column directional width of the entire stages SR1-SRn is larger than the column directional width of the entire pixel rows PXr1-PXrn, the space Aob adjacent to the stages SR1-SRn and disposed below or above the entire pixel rows PXr1-PXrn may be ensured. Accordingly, various elements such as a pad for inspection, a static diode, and the like or a pattern such as an alignment key for alignment of a mask and the like may be in the ensured space.

Figure 6:
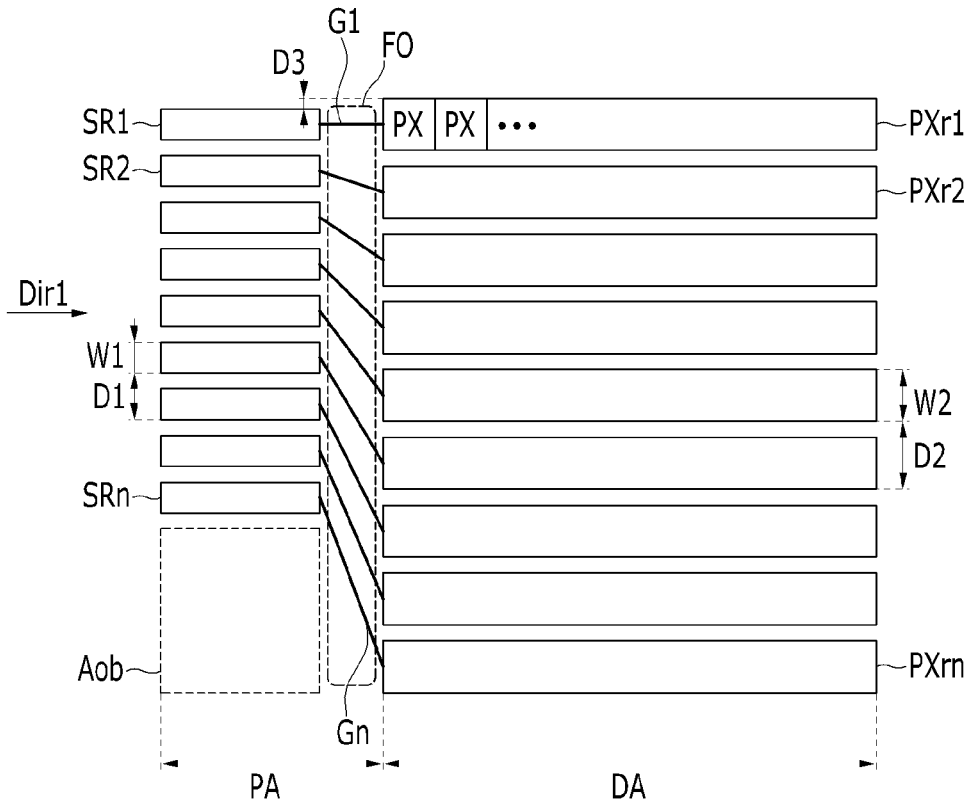
Figure 7:
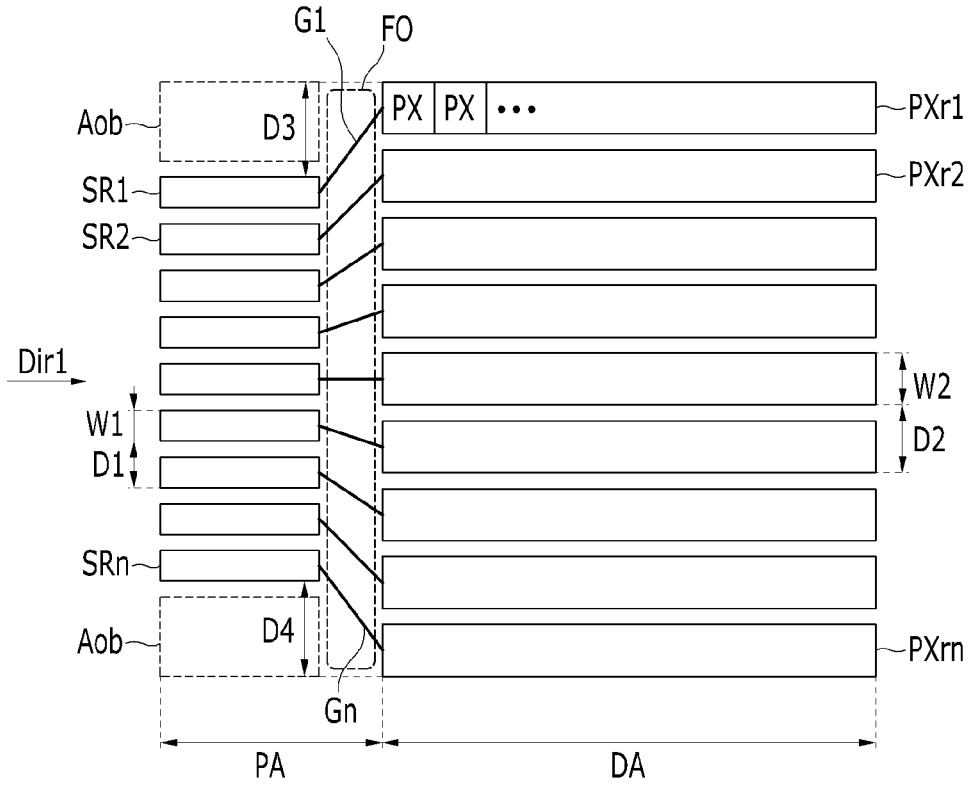
Figure 8:
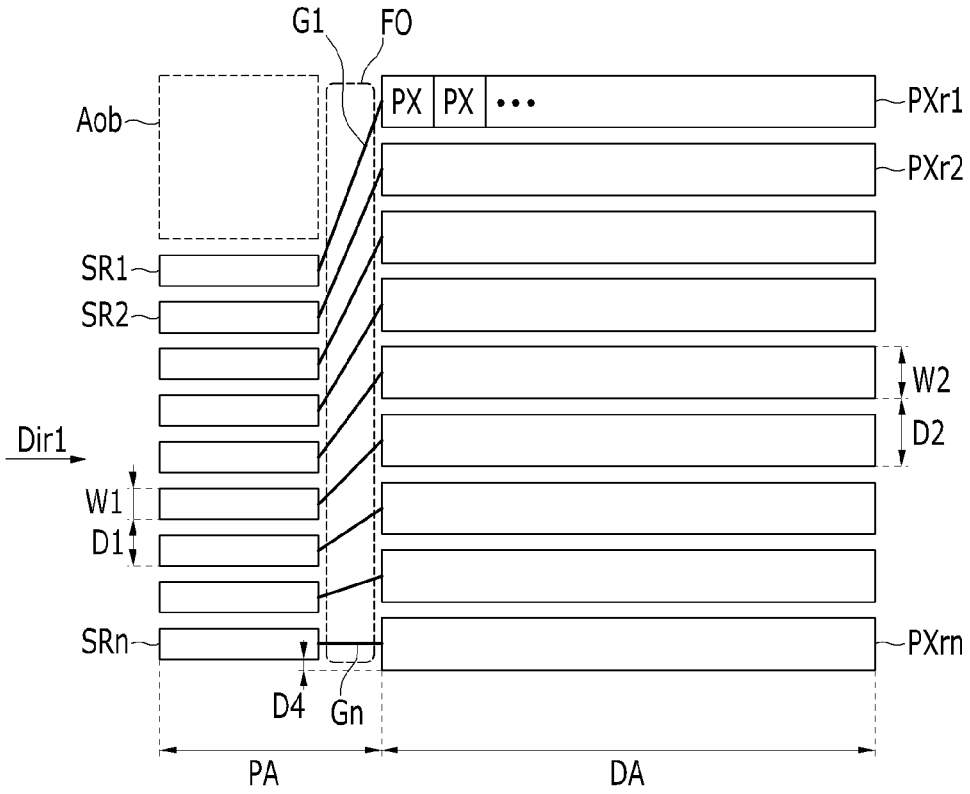

In the exemplary embodiment shown in FIGS. 6 to 8, the column directional width W1 of each of the entire stages SR1-SRn is smaller than the column directional width W2 of each of the pixel rows PXr1-PXrn. Accordingly, the column directional width of the entire stages SR1-SRn also becomes smaller than the column directional width of the entire pixel rows PXr1-PXrn.

Referring to FIG. 6, the uppermost stage SR1 and the uppermost pixel row PXr1 are aligned in a row direction Dir1. In this case, when one stage and one pixel row are aligned in a row direction Dir1 may mean that the center of the stage and the center of the pixel row are disposed on a straight line extending in a row direction Dir1 to be aligned with each other (hereinafter, the same as above). The column directional widths of the uppermost stage SR1 and the uppermost pixel row PXr1 are different from each other, such that the upper edge of the uppermost stage SR1 and the upper edge of the uppermost pixel row PXr1 are not disposed on the same line. That is, the column directional distance D3 between the upper edge of the uppermost stage SR1 and the upper edge of the uppermost pixel row PXr1 may not be 0. However, unlike described above, the column directional distance D3 may be 0. In the exemplary embodiment, a space Aob adjacent to at least a part of the pixel rows PXr1-PXrn and disposed below the plurality of stages SR1-SRn may be ensured.

Referring to FIG. 7, the uppermost stage SR1 and the uppermost pixel row PXr1 are not aligned in a row direction Dir1 and are misaligned and the last stage SRn and the last pixel row PXrn are not aligned in a row direction Dir1 and are misaligned. That is, both the column directional distance D3 between the upper edge of the uppermost stage SR1 and the upper edge of the uppermost pixel row PXr1 and the column directional distance D4 between the lower edge of the last stage SRn and the lower edge of the last pixel row PXrn may not be 0. In the exemplary embodiment, a space Aob adjacent to at least a part of the pixel rows PXr1-PXrn and disposed below and above the plurality of stages SR1-SRn may be ensured.

Referring to FIG. 8, the last stage SRn and the last pixel row PXrn are aligned in a row direction Dirt. However, the column directional widths of the last stage SRn and the last pixel row PXrn are different from each other, such that the lower edge of the last stage SRn and the lower edge of the last pixel row PXrn are not disposed on the same line. That is, the column directional width D4 between the lower edge of the last stage SRn and the lower edge of the last pixel row PXrn may not be 0. However, unlike described above, the column directional distance D4 may be 0. In the exemplary embodiment, a space Aob adjacent to at least a part of the pixel rows PXr1-PXrn and disposed above the plurality of stages SR1-SRn may be ensured.

Figure 9:
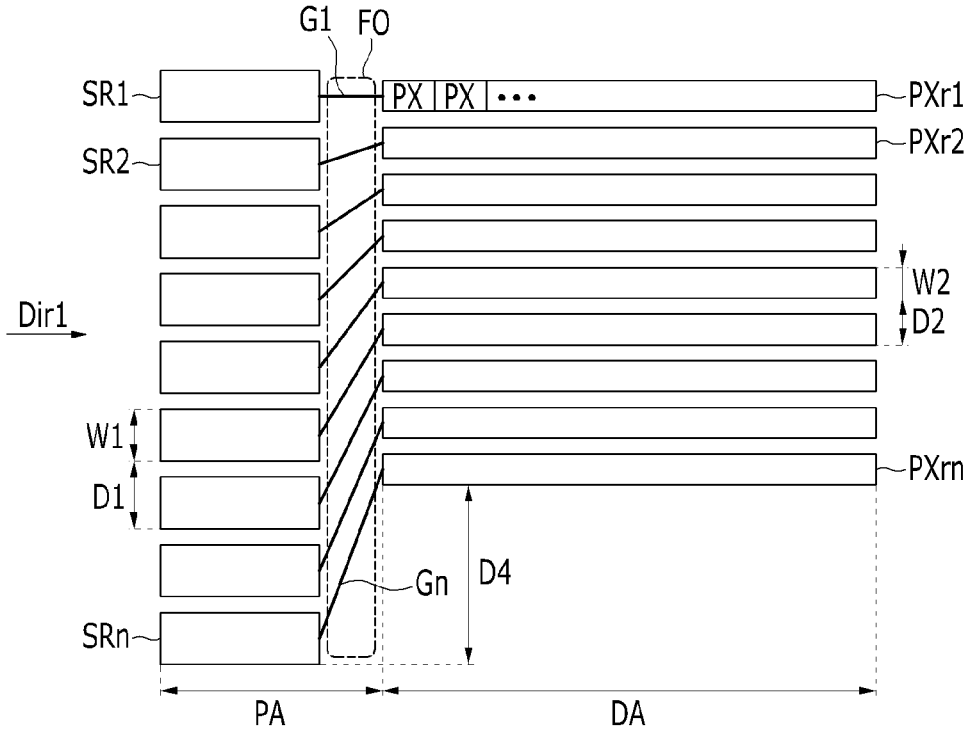
Figure 10:
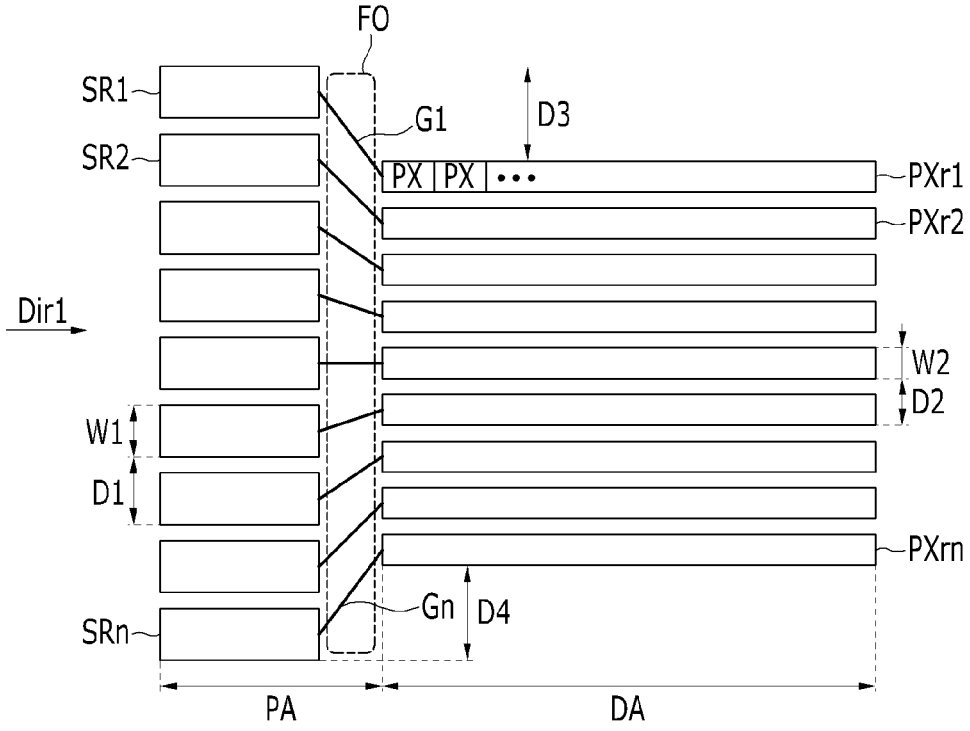
Figure 11:
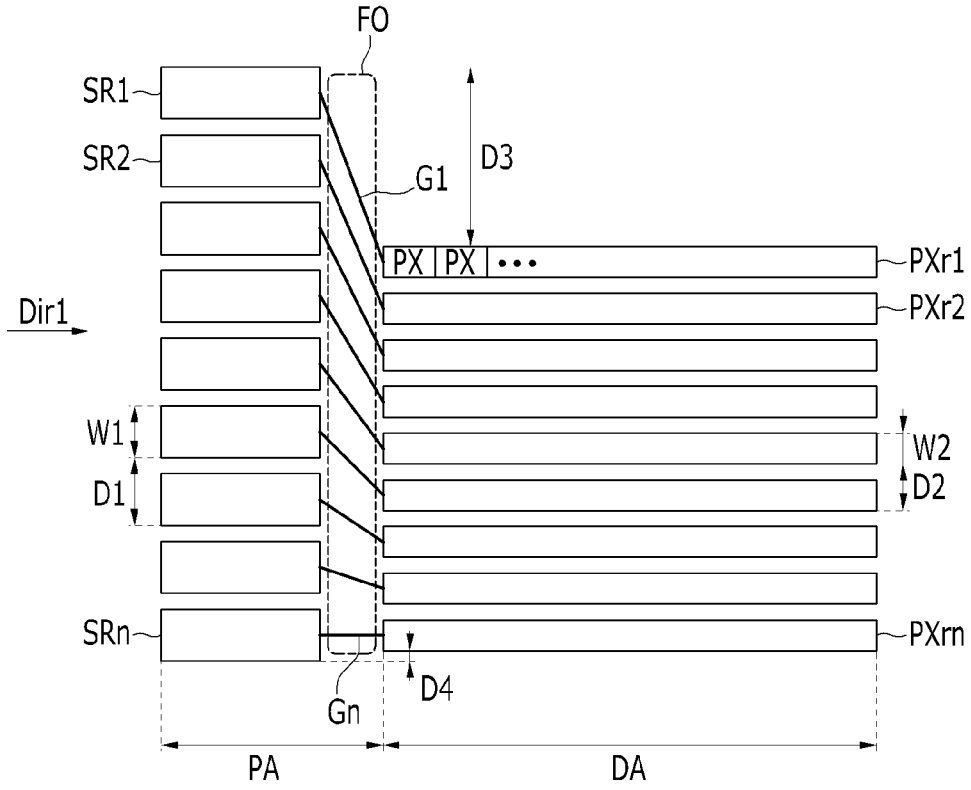

In the exemplary embodiment shown in FIGS. 9 to 11, the column directional width W2 of each of the entire pixel rows PXr1-PXrn is smaller than the column directional width W1 of each of the entire stages SR1-SRn. Accordingly, the column directional width of the entire stages SR1-SRn is larger than the column directional width of the entire pixel rows PXr1-PXrn.

Referring to FIG. 9, the uppermost stage SR1 and the uppermost pixel row PXr1 are aligned in a row direction Dir1. However, the column directional widths of the uppermost stage SR1 and the uppermost pixel row PXr1 are different from each other, such that the upper edge of the uppermost stage SR1 and the upper edge of the uppermost pixel row PXr1 are not disposed on the same line. The lower edge of the last stage SRn may be disposed further below the lower edge of the last pixel row PXrn. In the exemplary embodiment, a space adjacent to at least a part of the stages SR1-SRn and disposed below the plurality of pixel rows PXr1-PXrn may be ensured.

Referring to FIG. 10, the uppermost stage SR1 and the uppermost pixel row PXr1 are not aligned in a row direction Dir1 and are misaligned and the last stage SRn and the last pixel row PXrn are not aligned in a row direction and are misaligned. That is, both the column directional distance D3 between the upper edge of the uppermost stage SR1 and the upper edge of the uppermost pixel row PXr1 and the column directional distance D4 between the lower edge of the last stage SRn and the lower edge of the last pixel row PXrn may not be 0. In the exemplary embodiment, a space adjacent to at least a part of the stages SR1-SRn and disposed below and above the plurality of pixel rows PXr1-PXrn may be ensured.

Referring to FIG. 11, the last stage SRn and the last pixel row PXrn are aligned in a row direction Dirt. However, the column directional widths of the last stage SRn and the last pixel row PXrn are different from each other, such that the lower edge of the last stage SRn and the lower edge of the last pixel row PXrn are not disposed on the same line. That is, the column directional width D4 between the lower edge of the last stage SRn and the lower edge of the last pixel row PXrn may not be 0. However, unlike described above, the column directional distance D4 may be 0. In the exemplary embodiment, a space adjacent to at least a part of the stages SR1-SRn and disposed above the plurality of pixel rows PXr1-PXrn may be ensured.

Figure 12:
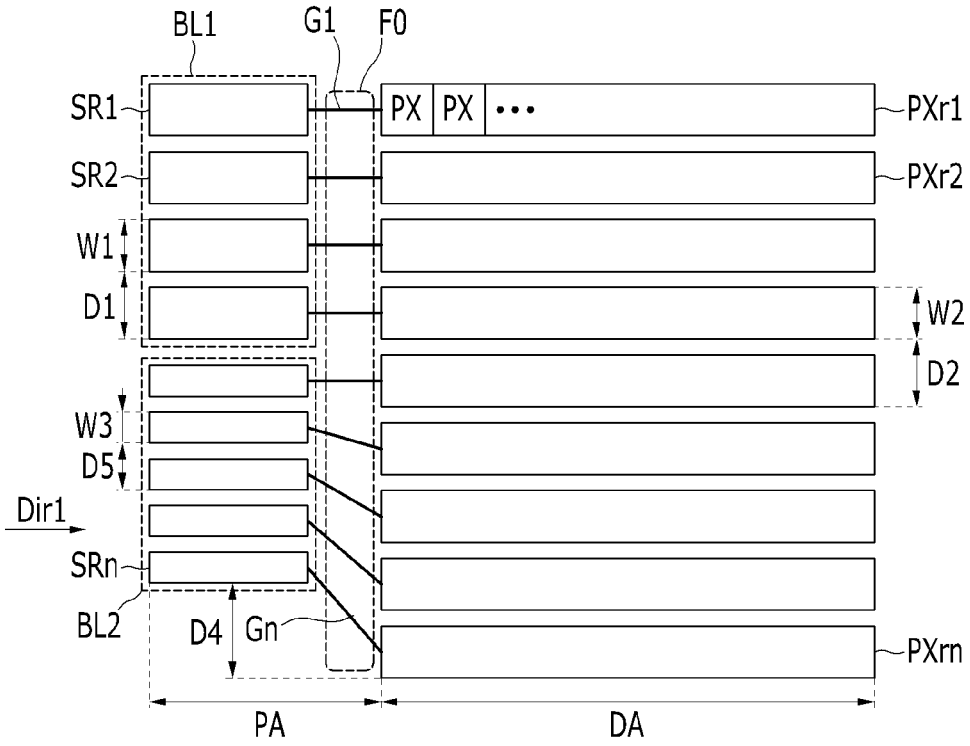

The exemplary embodiment shown in FIG. 12 is substantially the same as the exemplary embodiment shown in FIG. 6 as described above, but unlike the exemplary embodiment shown in FIG. 6, the entire stages SR1-SRn include at least two stages having different column directional widths or pitches. In the exemplary embodiment of FIG. 12, for example, the column directional width W3 of each of some stages may be smaller than the column directional width W1 of each of the remaining stages. In this case, the column directional width W1 of each of the remaining stages may be the same as the column directional width W2 of each of the pixel rows PXr1-PXrn.

In more detail, each of the entire stages SR1-SRn may be divided into two or more blocks including at least one stage, and the column directional width and pitch of each stage may be different in each block. The exemplary embodiment shown in FIG. 12 includes a first block BL1 and a second block BL2. The column directional width W1 of the stages included in the first block BL1 may be larger than the column directional width W3 of the stages included in the second block BL2. The column directional width of the stages within a same block BL1 and BL2 may be constant. A pitch D5 of the stages of the second block BL2 may be different from the pitch D1 of the stages of the first block BL1. In this case, the pitch D1 of the stages of the first block BL1 may be the same as the pitch D2 of the pixel rows PXr1-PXrn.

In the exemplary embodiment, the uppermost stage SR1 and the uppermost pixel row PXr1 are aligned in a row direction Dir1 and the upper edge of the uppermost stage SR1 and the upper edge of the uppermost pixel row PXr1 may be disposed on the same line.

Alternative to the exemplary embodiment shown in FIG. 12, the uppermost stage SR1 and the uppermost pixel row PXr1 may not be aligned in a row direction Dir1 and be misaligned.

In an alternative exemplary embodiment similar to the exemplary embodiment shown in FIG. 7, for example, the uppermost stage SR1 and the uppermost pixel row PXr1 may not be aligned in a row direction Dir1 and be misaligned and also, the last stage SRn and the last pixel row PXrn may not be aligned in a row direction Dir1 and be misaligned. That is, the uppermost stage SR1 may be disposed below the uppermost pixel row PXr1 and the last stage SRn may be disposed above the last pixel row PXrn. Accordingly, a space adjacent to at least a part of the pixel rows PXr1-PXrn and disposed above and below the plurality of stages SR1-SRn may be ensured, such that various elements such as a pad for inspection, a static diode, and the like or a pattern such as an alignment key for alignment of a mask and the like may be in the ensured space.

Further, according to another alternative exemplary embodiment similar to the exemplary embodiment shown in FIG. 8, the uppermost stage SR1 and the uppermost pixel row PXr1 may not be aligned in a row direction Dir1 and be misaligned and the last stage SRn and the last pixel row PXrn may be aligned in a row direction Dir1. That is, the uppermost stage SR1 may be disposed below the uppermost pixel row PXr1 and the last stage SRn may be aligned on a line parallel to the last pixel row PXrn in the first direction Dir1. In this case, the last gate line Gn may be parallel to the first direction Dir1. Accordingly, a space adjacent to at least a part of the pixel rows PXr1-PXrn and disposed above the plurality of stages SR1-SRn may be ensured, such that various elements such as a pad for inspection, a static diode, and the like or a pattern such as an alignment key for alignment of a mask and the like may be in the ensured space.

Figure 13:
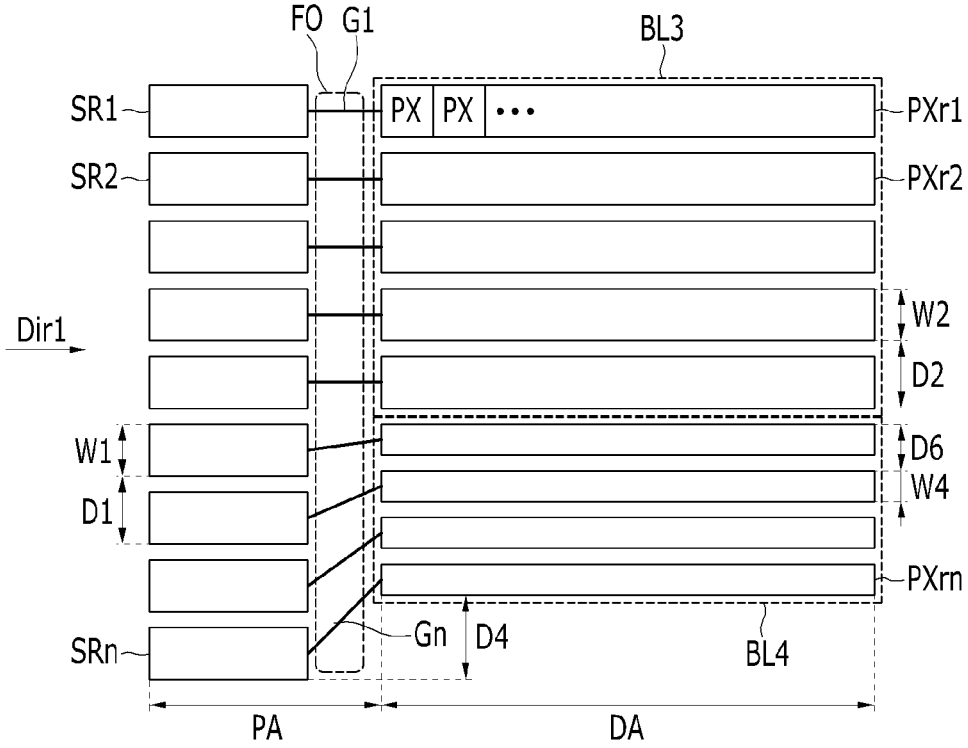

The exemplary embodiment shown in FIG. 13 is substantially the same as the exemplary embodiment shown in FIG. 9 as described above, but unlike the exemplary embodiment shown in FIG. 9, the entire pixel rows PXr1-PXrn include at least two pixel rows having different column directional widths. In the exemplary embodiment of FIG. 13, for example, the column directional width W4 of each of some pixel rows may be smaller than the column directional width W2 of each of the remaining pixel rows. In this case, the column directional width W4 of each of the remaining pixel rows may be the same as the column directional width W1 of each of the stages SR1-SRn.

In more detail, each of the entire pixel rows PXr1-PXrn may be divided into two or more blocks including at least one pixel row, and the column directional width of each pixel row may be different in each block. The exemplary embodiment shown in FIG. 13 includes a third block BL3 and a fourth block BL4. The column directional width W2 of the pixel rows included in the third block BL3 may be larger than the column directional width W4 of the pixel rows included in the fourth block BL4. The column directional width of the pixel rows disposed within a same block BL3 and BL4 may be constant. A pitch D6 of the pixel rows of the fourth block BL4 may be different from the pitch D2 of the pixel rows of the third block BL3. In this case, the pitch D2 of the pixel rows of the third block BL3 may be the same as the pitch D1 of the stages SR1-SRn.

In the exemplary embodiment, the uppermost stage SR1 and the uppermost pixel row PXr1 are aligned in a row direction Dir1 and the upper edge of the uppermost stage SR1 and the upper edge of the uppermost pixel row PXr1 may be disposed on the same line.

However, unlike the exemplary embodiment shown in FIG. 13, the uppermost stage SR1 and the uppermost pixel row PXr1 may not be aligned in a row direction Dir1 and be misaligned.

In an alternative exemplary embodiment similar to the exemplary embodiment shown in FIG. 10, for example, the uppermost stage SR1 and the uppermost pixel row PXr1 may not be aligned in a row direction Dir1 and be misaligned and also, the last stage SRn and the last pixel row PXrn may not be aligned in a row direction Dir1 and be misaligned. That is, the uppermost stage SR1 may be disposed above the uppermost pixel row PXr1 and the last stage SRn may be disposed below the last pixel row PXrn. Accordingly, a space adjacent to at least a part of the stages SR1-SRn and disposed above and below the plurality of pixel rows PXr1-PXrn may be ensured, such that various elements such as a pad for inspection, a static diode, and the like or a pattern such as an alignment key for alignment of a mask and the like may be in the ensured space.

Further, according to another alternative exemplary embodiment similar to the exemplary embodiment shown in FIG. 11, the uppermost stage SR1 and the uppermost pixel row PXr1 may not be aligned in a row direction Dir1 and be misaligned and the last stage SRn and the last pixel row PXrn may be aligned in a row direction Dir1. That is, the uppermost stage SR1 may be disposed above the uppermost pixel row PXr1 and the last stage SRn may be aligned on a line parallel to the last pixel row PXrn in the first direction Dir1. In this case, the last gate line Gn may be parallel to the first direction Dir1. Accordingly, a space adjacent to at least a part of the stages SR1-SRn and disposed above the plurality of pixel rows PXr1-PXrn may be ensured, such that various elements such as a pad for inspection, a static diode, and the like or a pattern such as an alignment key for alignment of a mask and the like may be therein.

Hereinafter, a shape of the gate lines G1-Gn in the fan-out region FO will be described in the exemplary embodiment shown in FIGS. 6 to 13.

In the exemplary embodiments shown in FIGS. 6 to 13, at least one of the gate lines G1-Gn in the fan-out region FO does not extend in parallel to a row direction Dir1. In more detail, the gate lines G1-Gn in the fan-out region FO respectively connecting the stages SR1-SRn and the pixel rows PXr1-PXrn which correspond to each other include one gate line G1-Gn parallel to the first direction Dirt that is, the row direction and the remaining gate lines may diagonally extend with respect to the row direction.

In the exemplary embodiment shown in FIGS. 6 and 9, the gate line G1 connecting the uppermost stage SR1 and the uppermost pixel row PXr1 extends in parallel to the row direction Dirt, and an angle of the remaining gate lines G2-Gn subsequent to the uppermost gate line G1 with respect to the row direction Dir1 may gradually increase and obliquely extend in a row direction Dir1. Accordingly, lengths of the gate lines G1-Gn in the fan-out region FO may gradually increase from the uppermost gate line G1 towards the last gate line Gn.

In the exemplary embodiments shown in FIGS. 7 and 10, when the number of the stages SR1-SRn is an odd number and two column directional distances D3 and D4 are the same as each other, only the gate line G((n+1/)2) connected to the stage SR((n+1)/2) which is disposed at the center of the gate lines G1-Gn may extend in parallel to the row direction Dir1 and an angle of the remaining gate lines with respect to the row direction Dir1 may gradually increase from the central gate line G((n+1)/2) towards the uppermost and last gate lines G1 and Gn and obliquely extend in the row direction Dirt. When the number of the stages SR1-SRn is an even number and two column directional distances D3 and D4 are the same as each other, an angle of the gate lines G1-Gn in a direction away from a virtual center line across the center of the stages SR1-SRn increases, diagonally extend in the row direction Dir1. Accordingly, lengths of the gate lines G1-Gn in the fan-out region FO may gradually increase upwards or downwards from the virtual center line across the center of the stages SR1-SRn. In this case, the stages SR1-SRn, the pixel rows PXr1-PXrn, and the gate lines G1-Gn may have symmetry with respect to the virtual center line.

On the contrary, when the two column directional distances D3 and D4 shown in FIGS. 7 and 10 are not the same as each other, none of the gate lines G1-Gn may be parallel to the row direction Dirt. However, when the stages SR1-SRn and the pixel rows PXr1-PXrn which are connected with each other are aligned in a row direction, the gate lines G1-Gn connected therewith may be parallel to the row direction Dir1.

In the exemplary embodiment shown in FIGS. 8 and 11, the gate line Gn connecting the last stage SRn and the last pixel row PXrn may extend in parallel to the row direction Dir1, and an angle of the remaining gate line G1-G(n−1) other than the last gate line Gn with respect to the row direction Dir1 may gradually increase and obliquely extend in the row direction Dir1. Accordingly, lengths of the gate lines G1-Gn in the fan-out region FO may gradually increase from the last gate line Gn towards the uppermost gate line G1.

In the exemplary embodiment shown in FIGS. 12 and 13, the shape of the gate lines G1-Gn is substantially the same as the exemplary embodiments shown in FIGS. 6 and 9 described above, but the gate lines extending in parallel to the row direction Dir1 in the fan-out region FO may be in plural.

In detail, in FIG. 12, the gate line in the fan-out region FO connected with the stage of the first block BL1 may be parallel to the row direction Dir1, the gate line connected with the uppermost stage among the gate lines in the fan-out region FO which is connected with the stage of the second block BL2 may extend in parallel to the row direction Dirt and an angle of the remaining gate lines with respect to the row direction Dir1 may gradually increase towards the last gate line Gn.

In FIG. 13, the gate line in the fan-out region FO connected with the pixel row of the third block BL3 may be parallel to the row direction Dir1, the gate line connected with the uppermost pixel row among the gate lines in the fan-out region FO which is connected with the pixel row of the fourth block BL4 may extend in parallel to the row direction Dirt and an angle of the remaining gate lines with respect to the row direction Dir1 may gradually increase towards the last gate line Gn.

Figure 14:
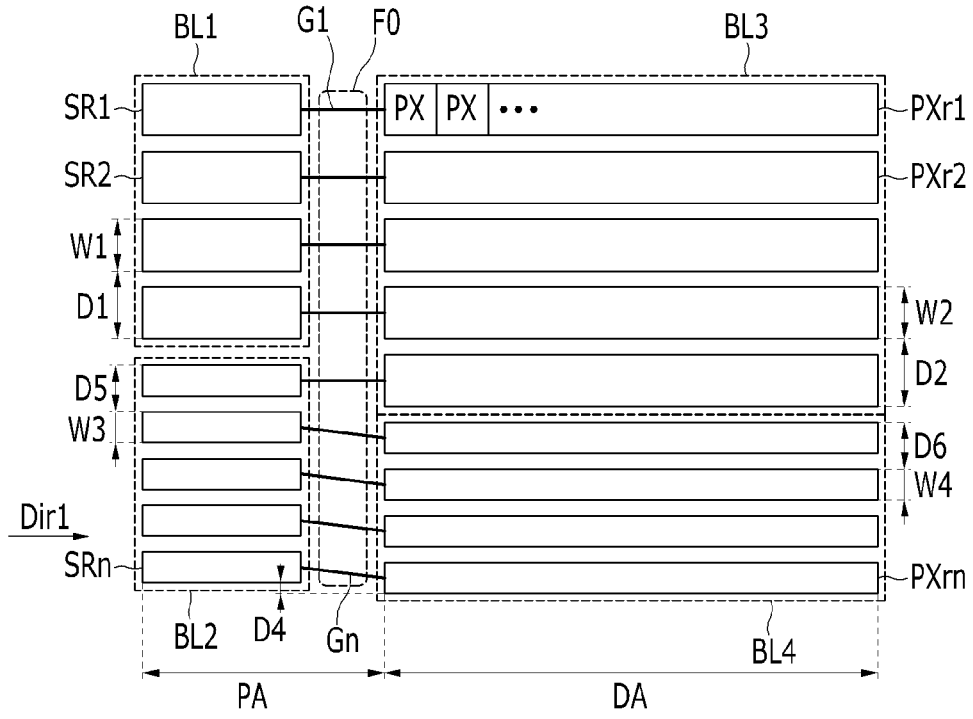
Figure 15:
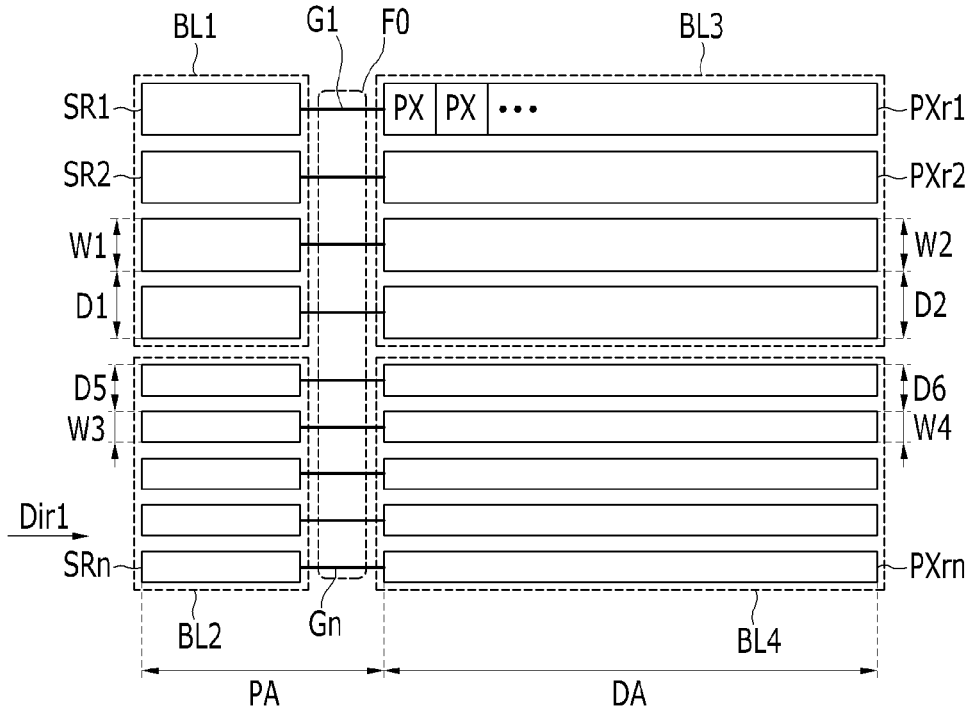

Next, referring to FIGS. 14 and 15, the exemplary embodiment includes all the features of the exemplary embodiment of FIGS. 12 and 13 described above and the duplicated description is omitted. In the exemplary embodiment, the column directional width W1 of the stages of the first block BL1 and the column directional width W2 of the pixel rows of the third block BL3 may be the same as each other, and the column directional width W3 of the stages of the second block BL2 and the column directional width W4 of the pixel rows of the fourth block BL4 may be the same as each other, within each respective block.

In more detail, in the exemplary embodiment shown in FIG. 14, since the number of the stages of the second block BL2 having the column directional width W3 relatively smaller than the column directional width W1 of the first block BL1 may not be the same as the number of the pixel rows of the fourth block BL4 having the column directional width W4 relatively smaller than the column directional width W2 third block BL3, the column directional widths of at least one stage and at least one pixel row which are connected with each other may be different from each other. Further, the column directional width of the entire stages SR1-SRn and the column directional width of the entire pixel rows PXr1-PXrn are different from each other. Unlike shown in FIG. 14, the entire stages SR1-SRn and the entire pixel rows PXr1-PXrn are not aligned with each other and may be misaligned like FIG. 3 or 5 described above.

According to the exemplary embodiment shown in FIG. 15, the number of the stages of the second block BL2 having the column directional width W3 relatively smaller than the column directional width W1 of first block BL1 may be the same as the number of the pixel rows of the fourth block BL4 having the column directional width W4 relatively smaller than the column directional width W2 of the third block BL3, and the column directional widths of the stages SR1-SRn and the pixel rows PXr1-PXrn which are connected with each other may be the same as each other. Further, the column directional width of the entire stages SR1-SRn and the column directional width of the entire pixel rows PXr1-PXrn are the same as each other. The upper edge of the uppermost stage SR1 and the upper edge of the uppermost pixel row PXr1 may be disposed on the same line and the lower edge of the last stage SRn and the lower edge of the last pixel row PXrn may be disposed on the same line. However, unlike shown in FIG. 15, the entire stages SR1-SRn and the entire pixel rows PXr1-PXrn may not be aligned with each other and may be misaligned like FIG. 3 or 5 described above. All the gate lines G1-Gn in the fan-out region FO may extend in parallel to the row direction Dir1.

Figure 16:
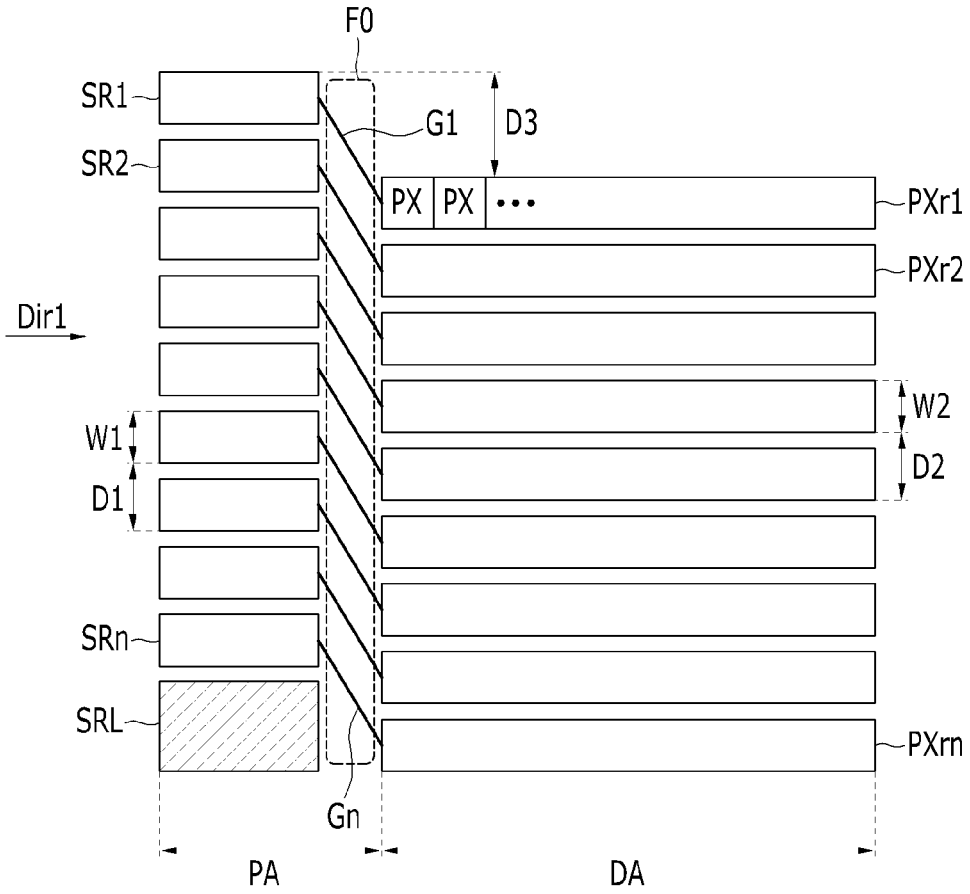

Next, referring to FIG. 16, the plurality of stages SR1-SRn and the plurality of pixel rows PXr1-PXrn according to the exemplary embodiment are substantially the same as the exemplary embodiment shown in FIGS. 3, 6, 7, and 12 described above, but another constituent element may be at a lower space Aob of the last stage SRn. FIG. 16 shows that a reset stage SRL is below the last stage SRn. The reset stage SRL is connected with at least one of the stages SR1-SRn disposed in ahead thereof and in scan driving, the stages SR1-SRn connected with the reset stage SRL output gate-off voltage Voff to reset the stages SR1-SRn. The reset stage SRL is not connected with the pixel PX of the display area DA. The column directional width of the reset stage SRL may be larger than the column directional width W1 of each of the remaining stages SR1-SRn or the column directional width W2 of each of the pixel rows PXr1-PXrn.

As described above, since the plurality of stages SR1-SRn and the plurality of pixel rows PXr1-PXrn are not aligned with each other and are misaligned, additional constituent elements such as the reset stage SRL and the like may be below the last stage SRn or above the uppermost stage SR1. Accordingly, the peripheral area PA below or above the display device and/or the stages need not be widened.

Unlike shown in FIG. 16, in the structure shown in FIGS. 5, 7, and 8 described above, constituent elements such as the reset stage SRL and the like may be above the uppermost stage SR1.

Figure 17:
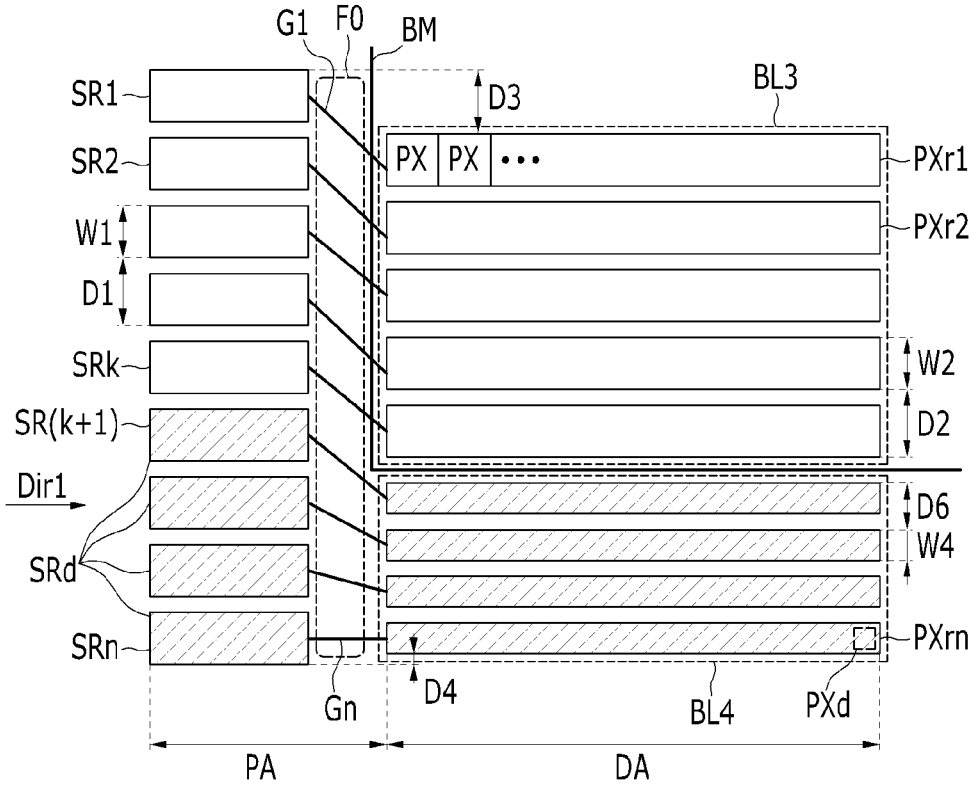

Next, referring to FIG. 17, a plurality of stages SR1-SRn and a plurality of pixel rows PXr1-PXrn according to the exemplary embodiment are substantially the same as the exemplary embodiment shown in FIG. 13 described above, but the last stage SRn and the last pixel row PXrn may be aligned with each other and the column directional distance D3 between the upper edge of the uppermost stage SR1 and the upper edge of the uppermost pixel row PXr1 may not be 0. In this case, since the column directional widths of the last stage SRn and the last pixel row PXrn are different from each other, the column directional distance D4 between the lower edge of the last stage SRn and the lower edge of the last pixel row PXrn may not be 0. However, unlike this, the column directional distance D4 may also be 0.

According to the exemplary embodiment, the pixel rows disposed at the fourth block BL4 may be covered by a light blocking member BM and may be disposed in the peripheral area PA of the display panel 300. As described above, a pixel which has the same structure as the pixel PX of the third block BL3 and does not actually display an image is called a dummy pixel PXd. The column directional width W4 of the pixel rows of the fourth block BL4 including the dummy pixel PXd may be smaller than the column directional width W2 of the pixel rows of the third block BL3. The stages SR(k+1)-SRn connected with the dummy pixels PXd are called dummy stages SRd and may have the same structure as the remaining stages (SR1-SRk) and operate substantially the same as the remaining stages (SR1-SRk). Since the dummy pixel PXd is not viewed at the outside of the display device, if a load of the gate line connected with the pixel rows of the fourth block BL4 is the same as a load of the gate line connected with the pixel rows of the third block BL3, the column directional width W4 of the pixel rows of the fourth block BL4 may be smaller than the column directional width W2 of the pixel rows of the third block BL3.

Unlike shown in FIG. 17, the column directional width of the dummy stage SRd may be smaller than the column directional width W1 of each of the remaining stages SR1-SRk. In one exemplary embodiment, for example, the column directional width of the dummy stage SRd may be the same as the column directional width W4 of the dummy pixel PXd. Accordingly, in the exemplary embodiment shown in FIG. 15 described above, the stages disposed at the second block BL2 is the dummy stage SRd and this may be the same as the case where the pixel rows of the fourth block BL4 is the dummy pixel PXd.

The gate line Gn in the fan-out region FO connecting the last stage SRn and the last pixel row PXrn may be parallel to the row direction Dirt Unlike shown in FIG. 17, the uppermost stage SR1 and the uppermost pixel row PXr1 may additionally be aligned with each other, such that the gate line G1 connecting the uppermost stage SR1 and the uppermost pixel row PXr1 may be parallel to the row direction Dir1 and the stages and the pixel rows which are disposed at the center are aligned with each other, such that the gate lines respectively connecting the stages and the pixel rows may be parallel to the row direction Dir1.

Figure 18:
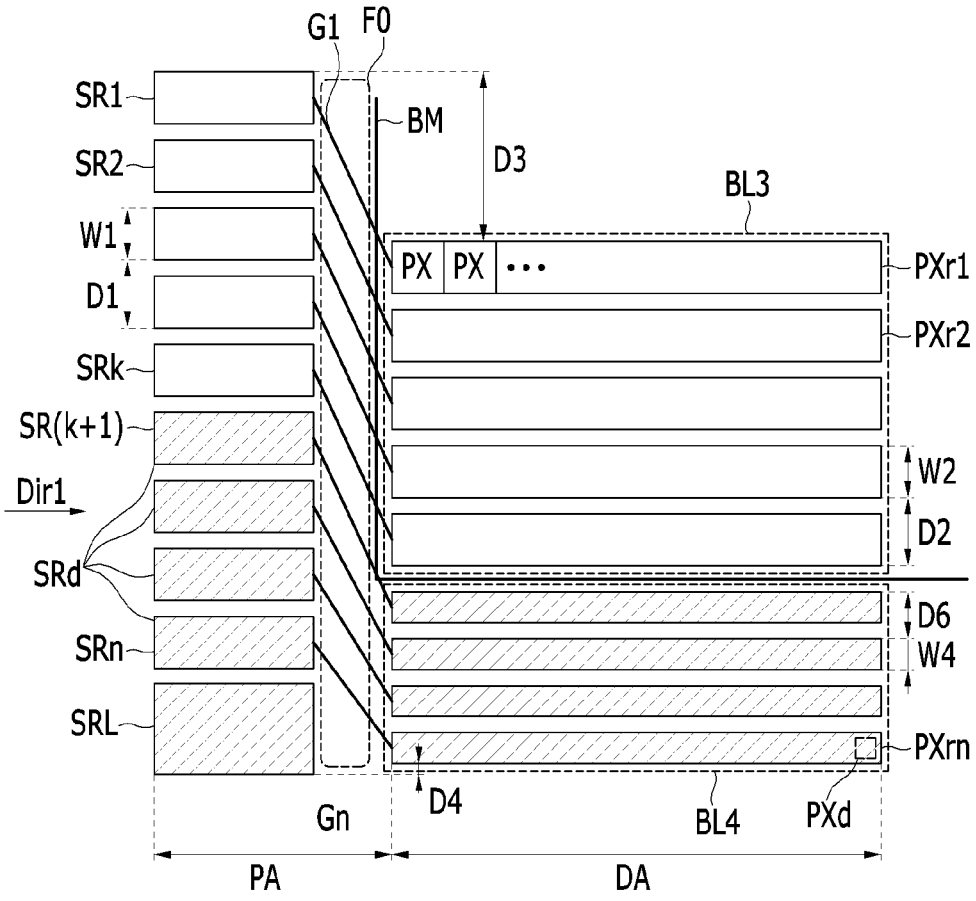

Referring to FIG. 18, the exemplary embodiment is substantially the same as the exemplary embodiment shown in FIG. 17 described above, but a constituent element such as a reset stage SRL is further below the last stage SRn. The reset stage SRL is the same as the reset stage SRL in FIG. 16 described above. In the exemplary embodiment, the lower edge of the reset stage SRL and the lower edge of the last pixel row PXrn may be aligned with each other. That is, the column directional distance D4 between the lower edge of the reset stage SRL and the lower edge of the last pixel row PXrn may be 0, but unlike this, may not be 0. Unlike shown in FIG. 18, the uppermost stage SR1 and the uppermost pixel row PXr1 may be aligned in the row direction. In addition, several features and effects of the exemplary embodiment of FIG. 17 may also be applied to the exemplary embodiment.

Figure 19:
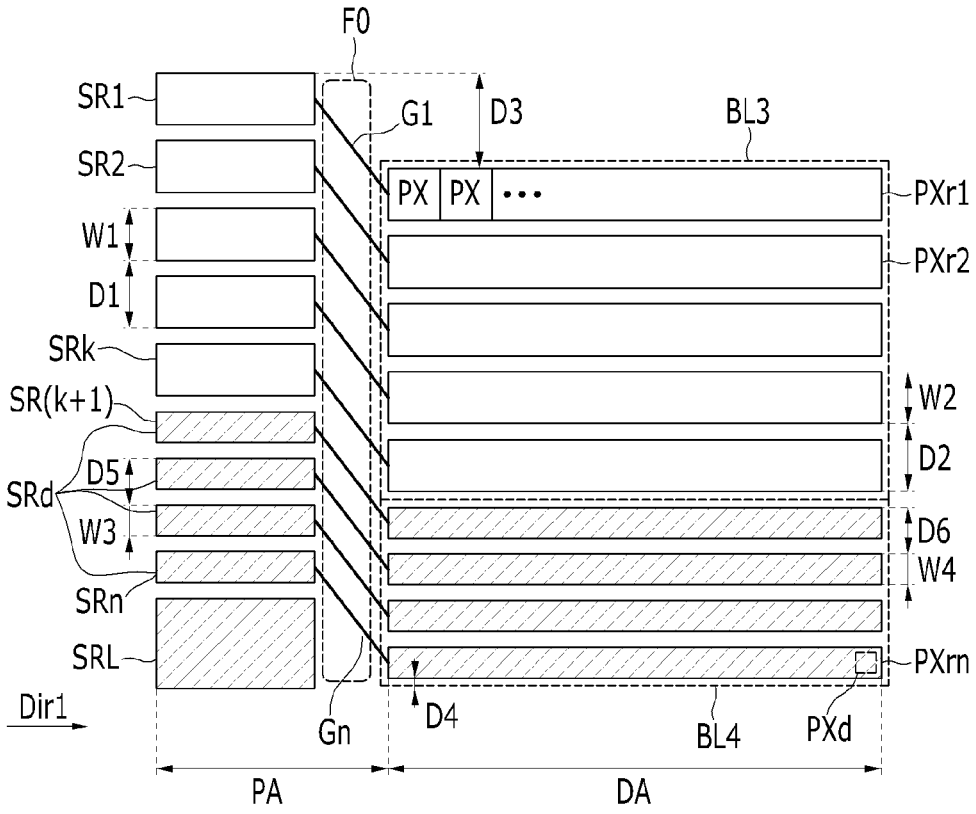

Next, referring to FIG. 19, a plurality of stages SR1-SRn and a plurality of pixel rows PXr1-PXrn of the display device according to the exemplary embodiment are substantially the same as the exemplary embodiment shown in FIG. 18 described above, but the column directional width W3 of the dummy stages SRd may be smaller than the column directional width W1 of the remaining stages SR1-SRk. In this case, the distance or the pitch D5 between the dummy stages SRd may be smaller than the pitch D1 of the remaining stages SR1-SRk. In an alternative exemplary embodiment, the reset stage SRL may be omitted. Unlike shown in FIG. 19, the pitch D5 between the dummy stages SRd may be larger than the pitch D1 of the remaining stages SR1-SRk.

Next, referring to FIG. 20, a plurality of stages SR1-SRn and a plurality of pixel rows PXr1-PXrn of the display device according to the exemplary embodiment are substantially the same as the exemplary embodiment shown in FIG. 6 described above, but a reset stage SRL is further in a lower space Aob below the last stage SRn. Since the feature of the reset stage SRL was described above, herein, the description is omitted. In the exemplary embodiment, the lower edge of the reset stage SRL and the lower edge of the last pixel row PXrn may be aligned and the uppermost stage SR1 and the upper edge of the uppermost pixel row PXr1 may be aligned. Unlike shown in FIG. 20, the lower edge of the last pixel row PXrn may be disposed above the lower edge of the reset stage SRL and the last stage SRn and the last pixel row PXrn may be aligned in the row direction.

Figure 20:
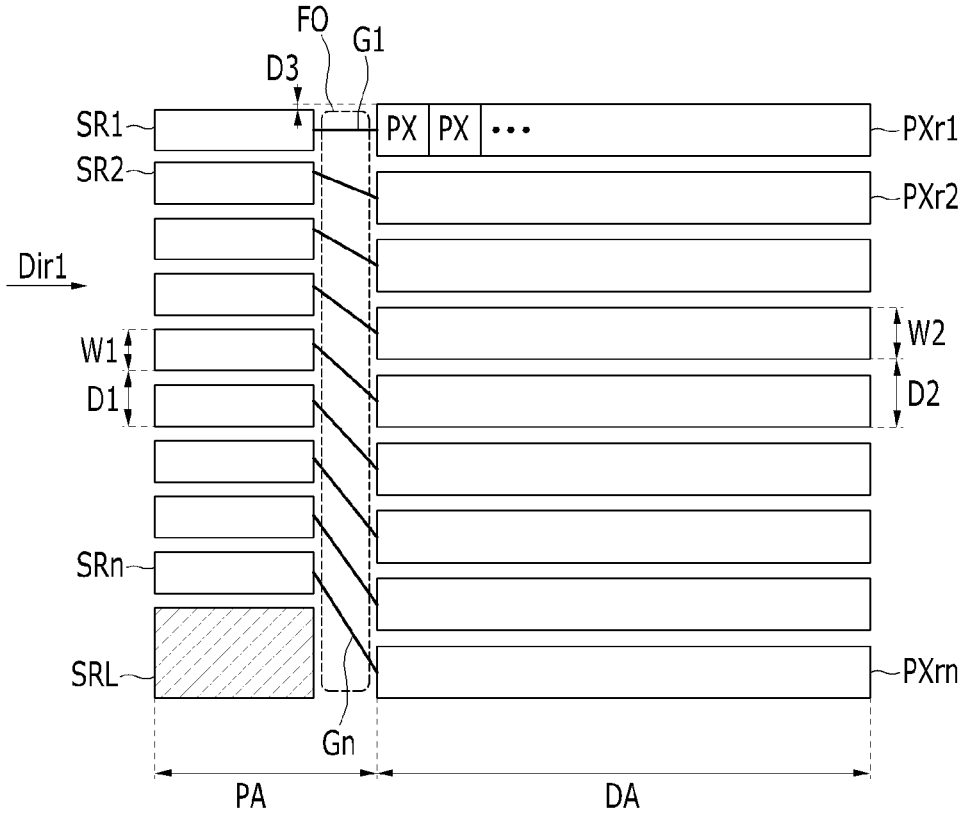
Figure 21:
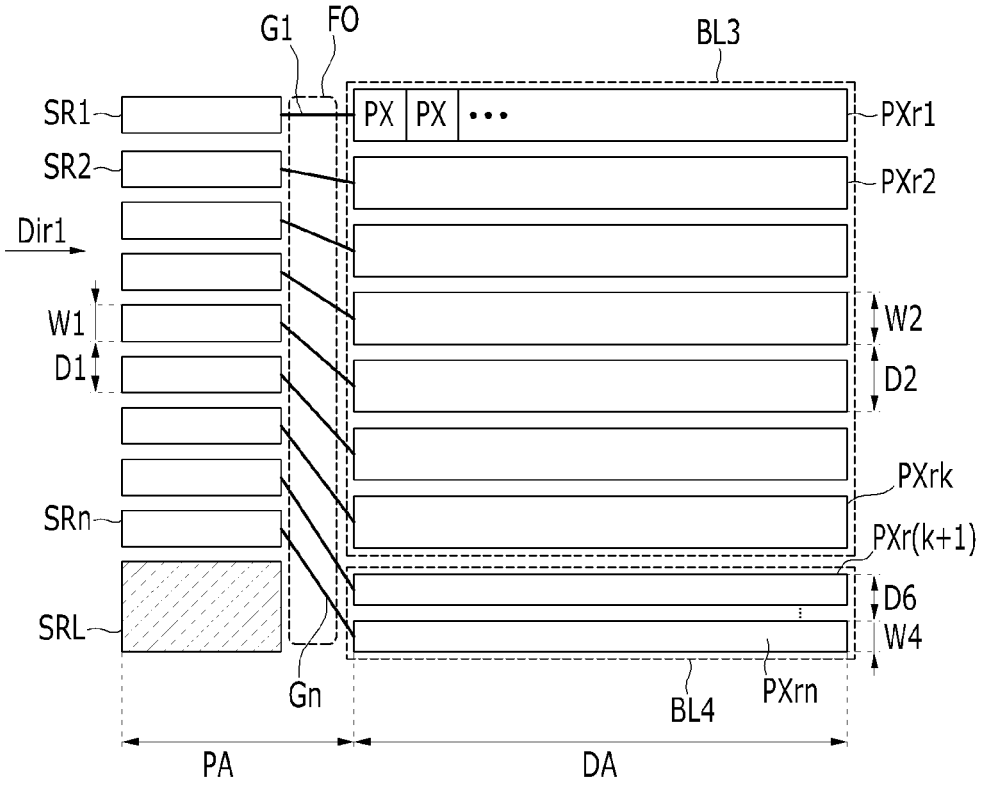

Referring to FIG. 21, a plurality of stages SR1-SRn and a plurality of pixel rows PXr1-PXrn of the display device according to the exemplary embodiment are substantially the same as the exemplary embodiment shown in FIG. 20 described above, but at least two pixel rows having different column directional widths are included like the exemplary embodiments shown in FIGS. 13, 14, 15, 17, and 18. In detail, the entire pixel rows PXr1-PXrn include the third block BL3 and the fourth block BL4 and the column directional width W2 of each of the pixel rows PXr1-PXrk of the third block BL3 may be larger than the column directional width W4 of each of the pixel rows PXr(k+1)-PXrn of the fourth block BL4. According to the exemplary embodiment, the column directional width W1 of each of the stages SR1-SRn may be smaller than the column directional width W1 of each of the stages SR1-SRn in the exemplary embodiment shown in FIG. 20. Unlike shown in FIG. 21, the lower edge of the last pixel row PXrn may be disposed above the lower edge of the reset stage SRL and the last stage SRn and the last pixel row PXrn may be aligned in the row direction.

Hereinafter, exemplary embodiments of gate lines G1-Gn of a fan-out region FO connecting a plurality of stages and a plurality of pixel rows according to the invention will be described with reference to FIGS. 22 to 24 together with FIGS. 1 to 21 described above.

Figure 22:
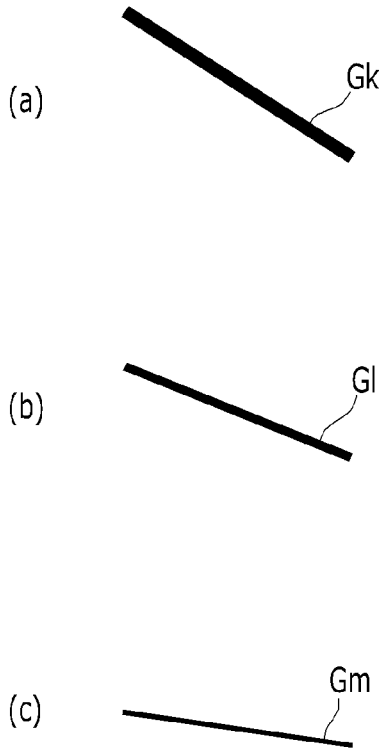
FIGS. 22 to 24 are diagrams showing exemplary embodiments of a shape of a gate line in a fan-out region of a display device according to the invention, respectively.
Figure 23:
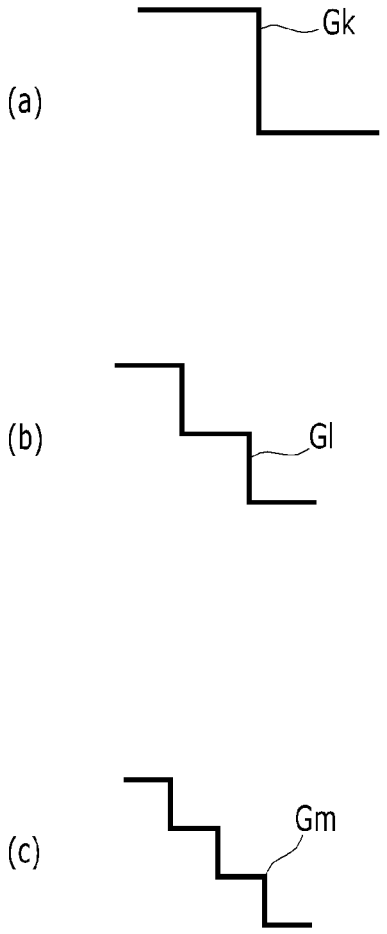
Figure 24:
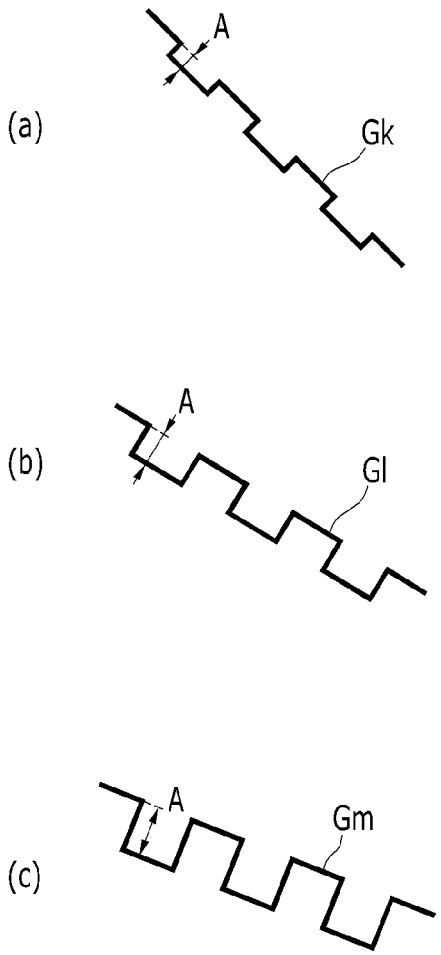

FIGS. 22 to 24 are diagrams showing exemplary embodiments of a shape of a gate line in a fan-out region FO of a display device according to the invention, respectively.

In the exemplary embodiments of the invention described above, the plurality of stages SR1-SRn of the gate driver 400 and the plurality of pixel rows PXr1-PXrn of the display area DA are connected with each other through the gate lines G1-Gn in the fan-out region FO. In the exemplary embodiments of the invention, at least some of the gate lines G1-Gn obliquely extend in a row direction.

Referring to FIG. 22, line widths taken perpendicular to a longitudinal direction of the gate line G1-Gn in the fan-out region FO of at least two gate lines among gate lines G1-Gn in the fan-out region FO, may be different from each other. In more detail, as lengths in the longitudinal direction of the gate lines G1-Gn in the fan-out region FO increase, the line widths of the gate lines G1-Gn may become thicker. In other words, as angles between the gate lines G1-Gn and the row direction Dir1 increase, the lengths of the gate lines G1-Gn in the fan-out region FO may further increase and the line widths may become thicker. Acute angles formed with the first direction Dirt, that is, the row direction Dir1 become gradually smaller in the order of a gate line Gk of FIG. 22A, a gate line Gl of FIG. 22B, and a gate line Gm of FIG. 22C and as a result, the line widths become smaller in the order of the gate line Gk, the gate line Gl, and the gate line Gm.

As described above, since the line widths of the gate lines G1-Gn in the fan-out region FO are differently set according to the lengths of the gate lines G1-Gn, the uniformity of the load of the gate signals transferred by the gate lines G1-Gn in the fan-out region FO may be maximized.

Referring to FIGS. 23 and 24, at least one gate line among the gate lines G1-Gn according to the exemplary embodiments may be bent at least once in the fan-out region FO.

First, referring to FIG. 23, the gate lines G1-Gn in the fan-out region FO may have a different number of bends according to a position thereof. In exemplary embodiments, for example, as a distance between the stages SR1-SRn and the pixel rows PXr1-PXrn respectively connected by the gate lines G1-Gn in the fan-out region FO increases, the gate lines G1-Gn in the fan-out region FO connecting the stages SR1-SRn and the pixel rows PXr1-PXrn may have a decreasing number of bends. Further, a straight portion between the bent points of the gate lines G1-Gn in the fan-out region FO may be substantially parallel or vertical to the row direction Dir1.

The gate line Gk shown in FIG. 23A is bent twice as an example, the gate line Gl shown in FIG. 23B is bent four times as an example, and the gate line Gm shown in FIG. 23C is bent six times as an example. In this case, the lengths of the gate lines in the fan-out region FO may gradually decrease in the order of the gate line Gk, the gate line Gl, and the gate line Gm and the number of bends may also gradually increase.

As described above, when a number of the bending points of the gate lines G1-Gn in the fan-out region FO varies according to a total length of the gate lines in the fan-out region FO, as the number of bending points increases, the resistance may increase, such that the load of the gate signals transferred by the gate lines G1-Gn in the fan-out region FO may be maximally uniform.

Next, referring to FIG. 24, at least one gate line among the gate lines G1-Gn according to the exemplary embodiments includes protrusions and depressions which are alternately arranged and may be periodically bent in a saw-toothed shape or a wave shape in the longitudinal direction of the gate line. The saw-toothed shape or wave shape may be quadrangle in which the edge is substantially at right angle as shown in FIG. 24 and unlike this, may be various polygons such as a triangle and the like or a curved line such as a sine wave. When the wave shape is the polygon, at least one of sides forming the wave shape may be obliquely inclined with respect to the row direction Dir1. When the gate lines G1-Gn are periodically bent in a saw-toothed shape or a wave shape, the gate lines G1-Gn have amplitudes A as shown in FIG. 24.

Further, the amplitudes A of the protrusions and the depressions of the gate lines G1-Gn may vary according to the entire lengths of the gate lines G1-Gn in the fan-out region FO. In the illustrated exemplary embodiments, for example, column directional distances between the stages SR1-SRn and the pixel rows PXr1-PXrn connected by gate lines G1-Gn increase in the order of a gate line Gk of FIG. 24A, a gate line Gl of FIG. 24B, and a gate line Gm of FIG. 24C. In other words, in the order of the gate line Gk of FIG. 24A, the gate line Gl of FIG. 24B, and the gate line Gm of FIG. 24C, a straight distance connecting both ends of the gate lines G1-Gn in the fan-out region FO increases and the amplitudes A of the protrusions and depressions of the gate lines G1-Gn in the fan-out region FO connecting the stage and the pixel row may further increase in the order. Accordingly, although the inclined angles of the gate lines G1-Gn in the fan-out region FO with respect to the row direction Dir1 are different, the lengths of the gate lines G1-Gn in the fan-out region FO may be substantially constant. Therefore, the load of the gate signals transferred by the gate lines G1-Gn in the fan-out region FO may be maximally uniform.

In the exemplary embodiment shown in FIGS. 22 to 24, the line widths or the number of times the gate lines G1-Gn is bent are different from each other or the bend amplitudes of the gate lines G1-Gn are different from each other, such that the resistance of the gate lines G1-Gn in the fan-out region FO is constant, but the method of making the resistance substantially uniform is not limited thereto. In an alternative embodiment, the resistance may be made substantially uniform by controlling both the line widths and the lengths of the gate lines G1-Gn, and a separate electrode or a pattern is at a layer different from the gate lines G1-Gn so as to overlap with the gate lines G1-Gn to form a capacitor, such that the load of the gate lines G1-Gn in the fan-out region FO may also be uniform.

In the exemplary embodiments of the invention, each of the pixel rows PXr1-PXrn disposed in the display area DA includes the plurality of pixels PX arranged in a row direction Dirt, but is not limited thereto. In an alternative exemplary embodiment, the plurality of pixels PX included in each of the pixel rows PXr1-PXrn are arranged not in the row direction Dir1 but another direction and may be arranged in various shapes, not in a line such as a zigzag shape.

While this invention has been described in connection with what is presently considered to be exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device, comprising:

a display panel including a display area displaying an image, and a peripheral area around the display area;

a scan driver including a plurality of stages integrated on the peripheral area and arranged linearly in a first direction, each of the plurality of stages including a thin film transistor;

a plurality of gate lines each connected to one of the plurality of stages;

a plurality of pixel rows linearly arranged in the first direction in the display area and respectively connected with the plurality of gate lines; and a dummy pixel row in the peripheral area, wherein the plurality of stages comprises stages connected to the plurality of pixel rows via a portion of the plurality of gate lines, respectively, and a dummy stage connected to the dummy pixel row via a gate line of the plurality of gate lines, the peripheral area includes a fan-out region between a region including the plurality of stages and a region including the plurality of pixel rows, and at least one of the plurality of gate lines in the fan-out region extends in a direction that is oblique with respect to both the first direction and a second direction perpendicular to the first direction.

2. The display device of claim 1, wherein:

a first stage of the plurality of stages and a first pixel row of the plurality of pixel rows are connected to each other by one gate line of the plurality of gate lines, and the first stage and the first pixel row are misaligned in the second direction.

3. The display device of claim 2, wherein:

an uppermost stage of the plurality of stages and an uppermost pixel row of the plurality of pixel rows are misaligned in the second direction.

4. The display device of claim 3, wherein:

a first distance in the first direction between an upper edge of the first stage and an upper edge of the first pixel row is equal to or more than a first width in the first direction of the first stage.

5. The display device of claim 4, wherein:

a last stage of the plurality of stages and a last pixel row of the plurality of pixel rows are misaligned in the second direction.

6. The display device of claim 4, wherein:

a first width in the first direction of each of the plurality of stages is constant.

7. The display device of claim 6, wherein:

a first width in the first direction of each of the plurality of pixel rows is constant.

8. The display device of claim 7, wherein:

the first width of each of the plurality of stages and the first width of each of the plurality of pixel rows are equal to each other.

9. The display device of claim 7, wherein:

the first width of each of the plurality of stages and the first width of each of the plurality of pixel rows are different from each other.

10. The display device of claim 9, wherein:

at least one of the plurality of gate lines in the fan-out region extends parallel to the second direction.

11. The display device of claim 10, wherein:

a gate line of the plurality of gate lines in the fan-out region extends parallel to the second direction, and remaining gate lines other than the gate line of the plurality of gate lines form angles with respect to the second direction, and the angles increase in a direction away from the gate line.

12. The display device of claim 9, wherein:

an entire of the plurality of gate lines in the fan-out region extend inclined with respect to the second direction, and are parallel to each other.

13. The display device of claim 2, wherein:

an uppermost stage among the plurality of stages and an uppermost pixel row of the plurality of pixel rows are aligned in the second direction, or a last stage of the plurality of stages and a last pixel row of the plurality of pixel rows are aligned in the second direction.

14. The display device of claim 13, wherein:

a first distance in the first direction between an upper edge of the first stage and an upper edge of the first pixel row is equal to or more than a first width in the first direction of the first stage.

15. The display device of claim 13, wherein:

a first width in the first direction of each of the plurality of stages is constant.

16. The display device of claim 15, wherein:

a first width in the first direction of each of the plurality of pixel rows is constant.

17. The display device of claim 16, wherein:

the first width of each of the plurality of stages and the first width of each of the plurality of pixel rows are different from each other.

18. The display device of claim 17, wherein:

at least one of the plurality of gate lines in the fan-out region extends parallel to the second direction.

19. The display device of claim 1, wherein:

the plurality of pixel rows includes a first block including at least one pixel row and a second block including at least one pixel row different from the at least one pixel row of the first block, and a first width in the first direction of the pixel row in the first block and a first width in the first direction of the pixel row in the second block are different from each other.

20. The display device of claim 19, wherein:

the first width of the pixel row in the first block is the same as a first width in the first direction of a first stage of the plurality of stages.

21. The display device of claim 20, wherein:

a first width in the first direction of each of the plurality of stages is constant.

22. The display device of claim 20, wherein:

the plurality of stages includes the first stage, and a second stage different from the first stage, of which first widths in the first direction are different from each other.

23. The display device of claim 19, wherein:

the second block is below the first block in a plan view, and the second block includes the dummy pixel.

24. The display device of claim 23, wherein:

a last pixel row of the second block and a last stage of the plurality of stages are aligned in the second direction.

25. The display device of claim 23, further comprising:

a reset stage below the plurality of stages in the plan view.

26. The display device of claim 25, wherein:

a lower edge of the reset stage and a lower edge of the last pixel row among the plurality of pixel rows are aligned in the second direction.

27. The display device of claim 1, wherein:

the plurality of stages includes a third block including at least one stage and a fourth block including at least one stage different from the at least one stage of the third block, and a first width in the first direction of a stage of the third block is different from a first width in the first direction of a stage of the fourth block.

28. The display device of claim 27, wherein:

the first width of the stage in the third block is the same as a first width in the first direction of a first pixel row in the plurality of pixel rows.

29. The display device of claim 28, wherein:

a first width in the first direction of each of the plurality of pixel rows is constant.

30. The display device of claim 28, wherein:

the plurality of pixel rows include the first pixel row, and a second pixel row different from the first pixel row, of which first widths in the first direction are different from each other.

31. The display device of claim 29, further comprising:

a reset stage below the plurality of stages in a plan view.

32. The display device of claim 1, wherein:

a first width in the first direction of a first stage included of the plurality of stages is different from a first width in the first direction of a first pixel row in the plurality of pixel rows.

33. The display device of claim 32, wherein:

a first width in the first direction of each of the plurality of stages is constant.

34. The display device of claim 32, wherein:

a first width in the first direction of each of the plurality of pixel rows is constant.

35. The display device of claim 32, further comprising:

a reset stage below the plurality of stages in a plan view.

36. The display device of claim 1, wherein:

the plurality of gate lines include two gate lines having thicknesses which are different from each other in the fan-out region, the thicknesses taken perpendicular to an extension direction of the gate lines.

37. The display device of claim 1, wherein:

a thickness of the gate lines in the fan-out region gradually increases or decreases along the first direction, the thickness taken perpendicular to an extension direction of the gate lines.

38. The display device of claim 1, wherein:

at least one of the plurality of gate lines is bent at least once in the fan-out region.

39. The display device of claim 38, wherein:

a number of bending points of the gate lines in the fan-out region, gradually increases or decreases in the first direction.

40. The display device of claim 39, wherein:

a gate line in the fan-out region includes a portion parallel to the first direction or the second direction.

41. The display device of claim 38, wherein:

a gate line in the fan-out region is periodically bent in a waveform.

42. The display device of claim 41, wherein:

an amplitude of the waveform of the gate lines in the fan-out region, gradually increases or decreases in the first direction.

43. The display device of claim 41, wherein:

a longitudinal length of each of the plurality of gate lines in the fan-out region is constant.

44. The display device of claim 1, wherein:

a width in the first direction of a stage connected to the pixel row is less than a width in the first direction of the pixel row and is greater than a width in the first direction of the dummy pixel row.

45. The display device of claim 1, wherein:

a width in the first direction of a stage connected to the pixel row is less than a width in the first direction of the pixel row and is greater than a width in the first direction of the dummy pixel row.

* * * * *